US006992427B2

(12) United States Patent
Yamagishi et al.

(10) Patent No.: US 6,992,427 B2
(45) Date of Patent: Jan. 31, 2006

(54) HIGH-YIELD CATHODE BODY, CATHODE SLEEVE STRUCTURE, AND CATHODE-RAY TUBE, CATHODE SLEEVE SUBSTRATE, AND CATHODE BODY PRODUCTION METHOD

(75) Inventors: Mika Yamagishi, Takatsuki (JP); Satoru Nakagawa, Takatsuki (JP); Yoji Yamamoto, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/321,890

(22) Filed: Dec. 17, 2002

(65) Prior Publication Data

US 2003/0173886 A1 Sep. 18, 2003

(30) Foreign Application Priority Data

Dec. 17, 2001 (JP) ..... 2001-382676
Apr. 1, 2002 (JP) ..... 2002-098376

(51) Int. Cl.
*H01J 1/20* (2006.01)

(52) U.S. Cl. ..... 313/270; 313/446; 313/337; 313/346 R; 313/346 DC

(58) Field of Classification Search ..... 313/456, 313/346 R, 346 DC, 270, 310, 311, 326; 445/50, 51
See application file for complete search history.

(56) References Cited

U.S. PATENT DOCUMENTS 4,184,100 A * 1/1980 Takanashi et al. ..... 313/337
4,370,588 A * 1/1983 Takahashi et al. ..... 313/270
5,164,631 A * 11/1992 Lee ..... 313/270
5,422,536 A * 6/1995 Hale et al. ..... 313/446
5,780,959 A * 7/1998 Pruvost et al. ..... 313/270

FOREIGN PATENT DOCUMENTS

JP 58175231 A * 10/1983

* cited by examiner

*Primary Examiner*—Karabi Guharay
*Assistant Examiner*—Sikha Roy

(57) ABSTRACT

A cathode sleeve structure for housing a heater. The cathode sleeve structure includes: a case member that is cylindrical and an end thereof is open; a plurality of supporting members that extend radially from vicinities of the end of the case member; and a linkage member that connects the plurality of supporting members. The case member, the plurality of supporting members, and the linkage member are formed as one piece.

11 Claims, 23 Drawing Sheets

FIG.6A
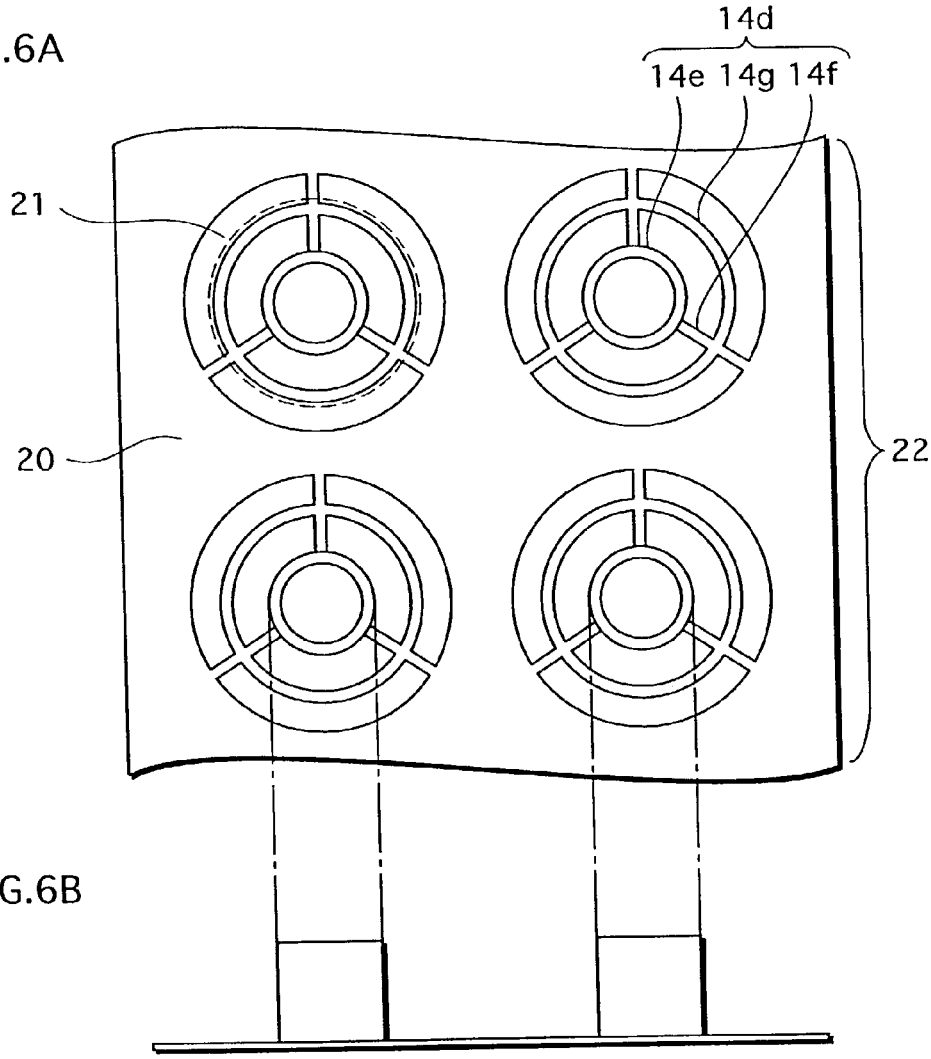
FIG.6B
FIG.6C
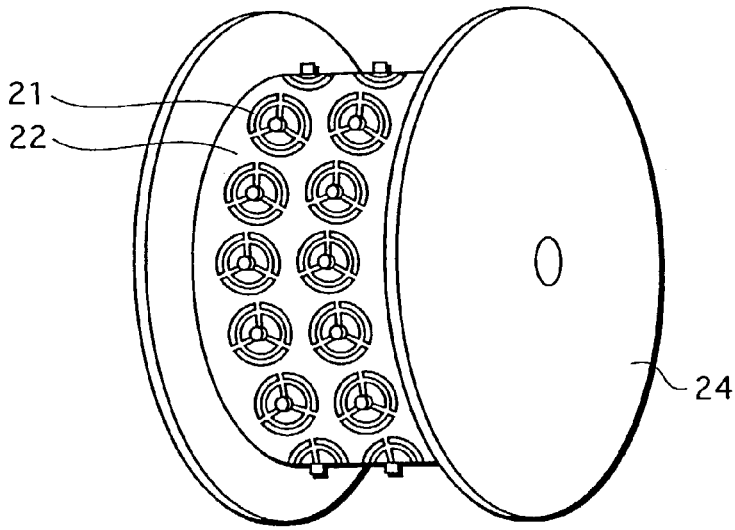

HIGH-YIELD CATHODE BODY, CATHODE SLEEVE STRUCTURE, AND CATHODE-RAY TUBE, CATHODE SLEEVE SUBSTRATE, AND CATHODE BODY PRODUCTION METHOD

BACKGROUND OF THE INVENTION (1) Field of the Invention

The present invention relates to a cathode body used in a cathode-ray tube or the like.

(2) Description of the Related Art

FIG. 1 shows a conventional cathode body 100. In the conventional cathode body 100, an opening of a cylindrical cathode sleeve 102, in which a heater 101 is housed, is covered by a cap member 103, and an electron emission material layer 104 is formed on an outer surface of the cap member 103.

Also, the cathode sleeve 102 and a cathode holding member 105 are fixed concentrically by means of three cathode sleeve supporting members 106, where both ends of each of the three supporting members 106 are welded to a side surface of the cathode sleeve 102 and onto a top end of the cathode holding member 105, respectively.

The cathode body 100 is produced by following a procedure composed of the following six processes.

1. First Welding Process

An end of each of the three supporting members 106 is welded to a side surface of the cathode sleeve 102.

2. Baking/Blacking Process

Metal particles are sprayed onto an inner surface of the cathode sleeve 102. The inner surface of the cathode sleeve 102 is then baked to be blacked.

3. Second Welding Process

The cap member 103 is welded to an opening of the cathode sleeve 102.

4. Layer Forming Process

The electron emission material layer 104 is formed by spraying an electron emission material onto an outer surface of the cap member 103.

5. Third Welding Process

The other end of each of the three supporting members 106 is welded onto the top end of the cathode holding member 105.

6. Heater Inserting Process

The heater 101 is inserted into the cathode sleeve 102, and the heater 101 and the cathode sleeve 102 are welded together.

Here, for the sake of convenience, an interim product obtained after the layer forming process is referred to as a cathode body member 107.

Similarly, an interim product obtained after the third welding process is referred to as a heater case 108 (not illustrated). Also, an interim product obtained after the first welding process to which the cathode sleeve supporting members 106 have been attached is referred to as a cathode sleeve structure 109 (not illustrated).

Meanwhile, the cathode sleeve supporting members 106 of the conventional cathode body 100 are made of Ni—Fe having low thermal conductivity, to minimize the heat loss caused by the heat flow from the cylindrical cathode sleeve 102 to the cathode holding member 105. Also, each of the cathode sleeve supporting members 106 is long and approximately 0.3 mm wide and 0.1 mm thick. As a result, the cathode sleeve supporting members 106 apt to be deformed by external forces.

Though being weak as described above, the cathode sleeve supporting members 106 are protected from external forces after the third welding process in which they are welded to the cathode holding member 105 that has high strength. However, it sometimes happens that the cathode sleeve supporting members 106 are deformed by external forces when the cathode body member 107 is stored, transferred, or loaded on an assembly jig, between the layer forming process and the third welding process.

In the third welding process, the welding is performed by automated welding equipment, and the cathode body member 107 needs to be positioned accurately for the welding. As a result, to put the cathode body member 107 at an accurate position and direction, a parts feeder is used. However, when passing through the parts feeder, or when being transferred from the parts feeder onto a welding rack, the cathode body member 107 apt to be deformed by external forces.

If a cathode body 100 containing a deformed cathode sleeve supporting member 106 is used in a final product, the cap member 103 is shifted from a position at which it is expected to be, and a distance between the electron emission material layer 104 and a control electrode (G1 electrode) deviates from a specified value in design. When this happens, a desired level of cut-off voltage is not obtained.

Deformed cathode body members 107 should be discarded so as not to be welded.

Also, if the cathode body member 107 fails to be positioned accurately in the third welding process, the cathode sleeve supporting members 106 are not welded to the cathode holding member 105 at correct positions as shown in FIG. 2. That is to say, there is a possibility that a welding defect occurs due to a shifted welding position.

If a welding defect is found in a heater case 108 after the welding process, the defective heater case 108 should also be discarded.

SUMMARY OF THE INVENTION

An object of the present invention is therefore to provide a high-yield cathode body, cathode sleeve structure, and cathode-ray tube, and a cathode sleeve substrate from which such a cathode sleeve structure is produced.

Another object of the present invention is to provide production methods of the high-yield cathode sleeve substrate and cathode body.

The above first object is fulfilled by (1) a cathode sleeve structure for housing a heater, comprising: a case member that is cylindrical and an end thereof is open; a plurality of supporting members that extend radially from vicinities of the end of the case member; and a linkage member that connects the plurality of supporting members, wherein the case member, the plurality of supporting members, and the linkage member are formed as one piece.

The supporting members of the cathode sleeve structure are typically thin to suppress the heat loss. In a production of a conventional cathode sleeve structure, any portion of the supporting members may be deformed before they are bonded to the holding member. In contrast, in the above-stated construction, since the supporting members are connected by the linkage member, the movement of the supporting members is restricted until they are bonded to the holding member. At the same time, if an external force is exerted on any supporting member, the force is distributed to the other supporting members, and the supporting members are prevented from being deformed.

Accordingly, in a production of a cathode body using the cathode sleeve structure, the number of products with defects by the deformation of the supporting members is reduced. This improves the yield in the cathode body production.

(2) In the cathode sleeve structure of (1), the linkage member may connect the plurality of supporting members at free ends of the supporting members, while the other ends are connected to the case member.

With the above-stated construction, the number of deformed supporting members is further reduced since the supporting members have no free end.

(3) In the cathode sleeve structure of (2), the linkage member may be substantially on a circle.

With the above-stated construction, an external force exerted on any supporting member is more apt to be distributed to the other supporting members.

(4) In the cathode sleeve structure of (3), the case member may have a first end and a second end, the first end being the end that is open, and the plurality of supporting members are bent at vicinities of boundaries between the case member and the supporting members, substantially at a same angle toward the second end.

With the above-stated construction, the supporting members are prevented from varying in shape. That is to say, the condition in which an external force is applied to each supporting member is unified.

(5) In the cathode sleeve structure of (4), the angle at which the plurality of supporting members are bent may be smaller than 90 degrees with respect to a central axis of the case member.

With the above-stated construction, the cathode sleeve structure becomes shorter. This reduces the area of an apparent surface on which an external force is exerted, making the cathode sleeve structure less susceptible to external forces.

(6) In the cathode sleeve structure of (1), when the number of the plurality of supporting members is expressed by n, an opening angle between each pair of adjacent supporting members may be approximately 360/n degrees.

With the above-stated construction, the condition in which an external force is applied to each supporting member is unified.

(7) In the cathode sleeve structure of (1), a principal element of a material of the case member, the plurality of supporting members, and the linkage member may be selected from the group consisting of Ni, Fe, Co, Ta, Mo, and Nb.

The above-stated construction provides more options for choice of materials, and gives more freedom in designing the cathode sleeve structure.

(8) In the cathode sleeve structure of (7), the material may contain one or more metals selected from the group consisting of Mg, Si, Cr, W, and Al.

With the above-stated construction, it is possible to use such metal content as a reducing agent for the electron emission material.

(9) In the cathode sleeve structure of (1), a principal element of a material of the case member, the plurality of supporting members, and the linkage member may be Cr.

With the above-stated construction, it is possible to form a black layer on the case member (the cathode sleeve) only by heating, without spraying metal powder thereon.

(10) In the cathode sleeve structure of (9), the material may contain one or more metals selected from the group consisting of Mg, Si, W, and Al.

With the above-stated construction, it is possible to use such metal content as a reducing agent for the electron emission material.

(11) In the cathode sleeve structure of (1), the case member may have a first end and a second end, the first end being the end that is open, and the second end is blocked by a member that is formed as one piece with the case member.

With the above-stated construction, the second end is automatically blocked as the case member is formed. That is to say, since there is no need for having a process in which a certain different member is slipped over and welded to the case member, other than a process for forming the case member, the chance that an external force is exerted on a supporting member is reduced.

The above first object is also fulfilled by

(12) a cathode sleeve structure for housing a heater, comprising: a case member that is cylindrical and an end thereof is open; a plurality of supporting members that extend radially from vicinities of the end of the case member; and a plurality of extending members that extend from the plurality of supporting members, respectively, portions of each pair of adjacent extending members being close to each other, wherein the case member, the plurality of supporting members, and the plurality of extending members are formed as one piece.

With the above-stated construction, if an external force is exerted in a direction in which adjacent supporting members get near, the extending members extending from the adjacent supporting members contact each other. This restricts the movement of the supporting members, and at the same time distributes the force to the other supporting members, preventing the deformation of the supporting members.

Accordingly, in a production of a cathode body using the cathode sleeve structure, the number of products with defects by the deformation of the supporting members is reduced. This improves the yield in the cathode body production.

(13) In the cathode sleeve structure of (12), the plurality of extending members may respectively extend from free ends of the plurality of supporting members, while the other ends are connected to the case member.

With the above-stated construction, if an external force is exerted on a supporting member and an extending member extending from the supporting member contacts another extending member within the elastic deformation, the movement of the end of the supporting member is restricted.

(14) In the cathode sleeve structure of (13), the plurality of extending members may be substantially on a same circle.

With the above-stated construction, if an external force is exerted on a supporting member, extending members are apt to contact each other, and at the same time, the external force is apt to be distributed to other supporting members.

(15) In the cathode sleeve structure of (14), the portions of each pair of adjacent extending members being close to each other may be ends thereof.

With the above-stated construction, if an external force is exerted on a supporting member, ends of extending members are apt to contact each other.

(16) In the cathode sleeve structure of (15), the shortest distance between each pair of adjacent extending members may be no greater than 0.5 mm.

With the above-stated construction, if an external force is exerted on a supporting member and an extending member extending from the supporting member contacts another extending member within the elastic deformation, the movement of the supporting member is restricted by the extending member. This also restricts the deformation of the supporting member since the external force is distributed to other supporting members.

The first object is also fulfilled by

(17) a cathode sleeve structure for housing a heater, comprising: a case member that is cylindrical and has a first end and a second end, the first end being open, and the case member being thicker at the first end than any other portions thereof so that a step is formed on an outer surface at the first end; and a plurality of supporting members that extend radially from the step at the first end of the case member, and are bent at vicinities of boundaries between the step and the supporting members toward the second end.

With the above-stated construction, the supporting members are bent at vicinities of boundaries between (i) the step where the case member is thicker and (ii) the supporting members, a crack is less apt to be caused by the bending.

(18) In the cathode sleeve structure of (17), each of the plurality of supporting members may be a plate being t mm thick, and a length of the step in a longitudinal direction of the case member is no smaller than t mm and no larger than 3.5 t mm.

The above-stated construction prevents a crack from being generated by the bending, without a great increase the heat loss.

The first object is also fulfilled by

(19) a cathode body, comprising: the cathode sleeve structure defined in (1); and a holding member that is bonded to either (a) ends of the plurality of supporting members or (b) the linkage member so that the cathode sleeve structure is fixed substantially at a center of the holding member.

In the cathode sleeve structure, the case member is held by the holding member that is bonded to either (a) ends of the plurality of supporting members or (b) the linkage member.

The supporting members of the cathode sleeve structure are typically thin to suppress the heat loss. In a production of a conventional cathode sleeve structure, any portion of the supporting members may be deformed before they are bonded to the holding member. In contrast, in the above-stated construction, since the supporting members are connected by the linkage member, the movement of the supporting members is restricted until they are bonded to the holding member. At the same time, if an external force is exerted on any supporting member, the force is distributed to the other supporting members, and the supporting members are prevented from being deformed.

Accordingly, in a production of a cathode body using the cathode sleeve structure, the number of products with defects by the deformation of the supporting members is reduced. This improves the yield in the cathode body production.

The first object is also fulfilled by

(20) a cathode body, comprising: the cathode sleeve structure defined in (12); and a holding member that surrounds the cathode sleeve structure and is bonded to either (i) ends of the plurality of supporting members or (ii) the plurality of extending members so that the cathode sleeve structure is fixed substantially at a center of the holding member.

With the above-stated construction, the movement of the supporting members is restricted by the extending members until the supporting members are bonded to the holding member. At the same time, if an external force is exerted on any supporting member, the force is distributed to the other supporting members, and the supporting members are prevented from being deformed.

Accordingly, in a production of a cathode body using the cathode sleeve structure, the number of products with defects by the deformation of the supporting members is reduced. This improves the yield in the cathode body production.

The first object is also fulfilled by

(21) a cathode ray tube, comprising: an electron gun including the cathode body defined in (20). The above-stated construction improves the yield of the cathode body used in the cathode ray tube, thus improving the yield of the cathode ray tube.

The first object is also fulfilled by

(22) a cathode sleeve substrate from which a cathode sleeve structure is produced, comprising: a plurality of case members projecting from a surface of a thin metal plate; and a plurality of supporting members that are part of the thin metal plate and extend from vicinities of a root of each case member radially.

With the above-stated construction in which a plurality of sets of a case member and supporting members are formed on a thin metal plate, it is possible to store and transfer the plurality of sets of a case member and supporting members without supporting them directly, but by supporting only part of the thin metal plate.

That is to say, the case members and supporting members are less apt to receive an external force directly.

Furthermore, the case members and supporting members are formed at predetermined positions on the thin metal plate. As a result, when they are processed by automated equipment while they are part of the thin metal plate, the positioning is easy.

(23) The cathode sleeve substrate of (22) may further comprise a linkage member that connects, for each case member, the plurality of supporting members.

With the above-stated construction, even after sets of a case member, supporting members, and linkage member are separated from the thin metal plate, the deformation of the supporting members is restricted by the linkage member.

(24) The cathode sleeve substrate of (22) may further comprise a plurality of extending members that extend, for each case member, from the plurality of supporting members, respectively, portions of each pair of adjacent extending members being close to each other.

With the above-stated construction, even after sets of a case member, supporting members, and extending members are separated from the thin metal plate, the deformation of the supporting members is restricted by the extending members.

The second object is fulfilled by

(25) a method of producing a cathode sleeve substrate from which a cathode sleeve structure is produced, comprising: a case member forming step for forming at least one cylindrical case member as a projection from a thin metal plate by partially deforming the thin metal plate; a supporting member forming step for forming a plurality of supporting members that extend from vicinities of a root of each case member radially, by removing parts of the thin metal plate; and a linkage member forming step for forming, by removing parts of the thin metal plate, a linkage member that connects the plurality of supporting members.

With the above-stated construction, each set of a case member, supporting members, and linkage member is formed by partially deforming and removing the thin metal plate.

That is to say, since there is no process of bonding each set of the case member, supporting members, and linkage member together and they are formed as one piece, the cathode sleeve substrate can easily be produced.

(26) In the cathode sleeve substrate production method of (25), in the case member forming step, a plurality of cylindrical case members may be formed as projections from the thin metal plate, in the supporting member forming step, the plurality of supporting members are formed for each case member, and in the linkage member forming step, the linkage member is formed for each case member.

With the above-stated construction, a plurality of sets of a case member, a plurality of supporting members, and a linkage member are stored and transferred as one thin metal plate.

(27) The cathode sleeve substrate production method of (26) may further comprise a bobbin winding step for winding, around a bobbin, the thin metal plate on which the case members, the supporting members, and the linkage member are formed.

With the above-stated construction, the case members, the supporting members, and the linkage member are less apt to receive an external force. This enables the cathode sleeve substrate to be stored and transferred while they keep the quality at the time of production.

The second object is also fulfilled by

(28) a method of producing a cathode sleeve substrate from which a cathode sleeve structure is produced, comprising: a case member forming step for forming at least one cylindrical case members as a projection from a thin metal plate by partially deforming the thin metal plate; a supporting member forming step for forming a plurality of supporting members that extend from vicinities of a root of the case member radially, by removing parts of the thin metal plate; and an extending member forming step for forming, by removing parts of the thin metal plate, a plurality of extending members that extend from the plurality of supporting members, respectively, portions of each pair of adjacent extending members being close to each other.

With the above-stated construction, each set of a case member, supporting members, and extending members is formed by partially deforming and removing the thin metal plate.

That is to say, since there is no process of bonding each set of the case member, supporting members, and extending members together and they are formed as one piece, the cathode sleeve substrate can easily be produced.

(29) In the cathode sleeve substrate production method of (28), in the case member forming step, a plurality of cylindrical case members may be formed as projections from the thin metal plate, in the supporting member forming step, the plurality of supporting members are formed for each case member, and in the extending member forming step, the plurality of extending members are formed for each case member.

With the above-stated construction, a plurality of sets of a case member, a plurality of supporting members, and a plurality of extending members are stored and transferred as one thin metal plate.

(30) The cathode sleeve substrate production method of (29) may further comprise a bobbin winding step for winding, around a bobbin, the thin metal plate on which the case members, the supporting members, and the extending members are formed.

With the above-stated construction, the case members, the supporting members, and the extending members are less apt to receive an external force. This enables the cathode sleeve substrate to be stored and transferred while they keep the quality at the time of production.

The second object is also fulfilled by

(31) a method of producing a cathode sleeve substrate from which a cathode sleeve structure is produced, comprising: a case member forming step for forming at least one cylindrical case member as a projection from a thin metal plate by partially deforming the thin metal plate; a step forming step for forming a step at the root of the case member by partially deforming the thin metal plate so that the root of the case member is thicker than any other portions thereof; and a supporting member forming step for forming a plurality of supporting members that extend from the step of the case member radially, by removing parts of the thin metal plate.

With the above-stated construction, each set of a case member, supporting members, and linkage member is formed by partially deforming and removing the thin metal plate.

That is to say, since there is no process of bonding each set of the case member, supporting members, and linkage member together and they are formed as one piece, the cathode sleeve substrate can easily be produced.

(32) In the cathode sleeve substrate production method of (31), in the case member forming step, a plurality of cylindrical case members may be formed as projections from the thin metal plate, and in the supporting member forming step, the plurality of supporting members are formed for each case member.

With the above-stated construction, a plurality of sets of a case member and a plurality of supporting members are stored and transferred as one thin metal plate.

The second object is also fulfilled by

(33) a method of producing a cathode body from the cathode sleeve substrate defined in (23), comprising: a separation step for separating, by cutting, sets of a case member, a plurality of supporting members, and a linkage member from the thin metal plate; and a welding step for, after the separation step, welding a cylindrical holding member to either (i) ends of the plurality of supporting members or (ii) the linkage member, for each set thereof.

With the above-stated construction, the supporting members are less apt to receive an external force directly. This prevents deformation of the supporting members.

(34) The cathode body production method of (33), wherein the separation step is performed in a latter half of the whole process of the cathode body production method, in a time series.

With the above-stated construction, in more than half processes, the case members, supporting members, and either the linkage member or extending members are kept to be contained in the cathode sleeve substrate. This provides areas other than these members on the cathode sleeve substrate to be used for supporting or binding thereof. This makes the case members, supporting members, and either the linkage member or extending members less apt to receive an external force directly, further improving the yield.

Furthermore, the case members and supporting members are formed at predetermined positions on the thin metal plate until they are separated from the thin metal plate. As a result, the positioning is easy.

(35) The cathode body production method of (34) may further comprise a slit forming step that is performed before the separation step and forms slits by either cutting or removing part of each linkage member.

The above-stated construction in which the linkage members have slits provides more freedom in press-molding the linkage members and supporting members.

The second object is also fulfilled by

(36) a method of producing a cathode body from the cathode sleeve substrate defined in (31), comprising: a separation step for separating, by cutting, sets of a case member and a plurality of supporting members from the thin metal plate; a bending step for bending each supporting member by pressing down the case member using an edge of the step as a point of application of force while fixing an end of each supporting member; and a welding step for, after the bending step, welding a holding member to the plurality of supporting members, for each set thereof.

With the above-stated construction having such a bending step, the bent supporting members are less apt to have a crack.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings:

FIG. 6A is a top plan view of the cathode sleeve substrate 22;

FIG. 6B is a side view of the cathode sleeve substrate 22;

FIG. 6C shows how the cathode sleeve substrate 22 is stored and transferred;

DESCRIPTION OF THE PREFERRED EMBODIMENT

The following describes a cathode body production method in Embodiment 1 with reference to the attached drawings.

Embodiment 1

Construction

Figure 1:
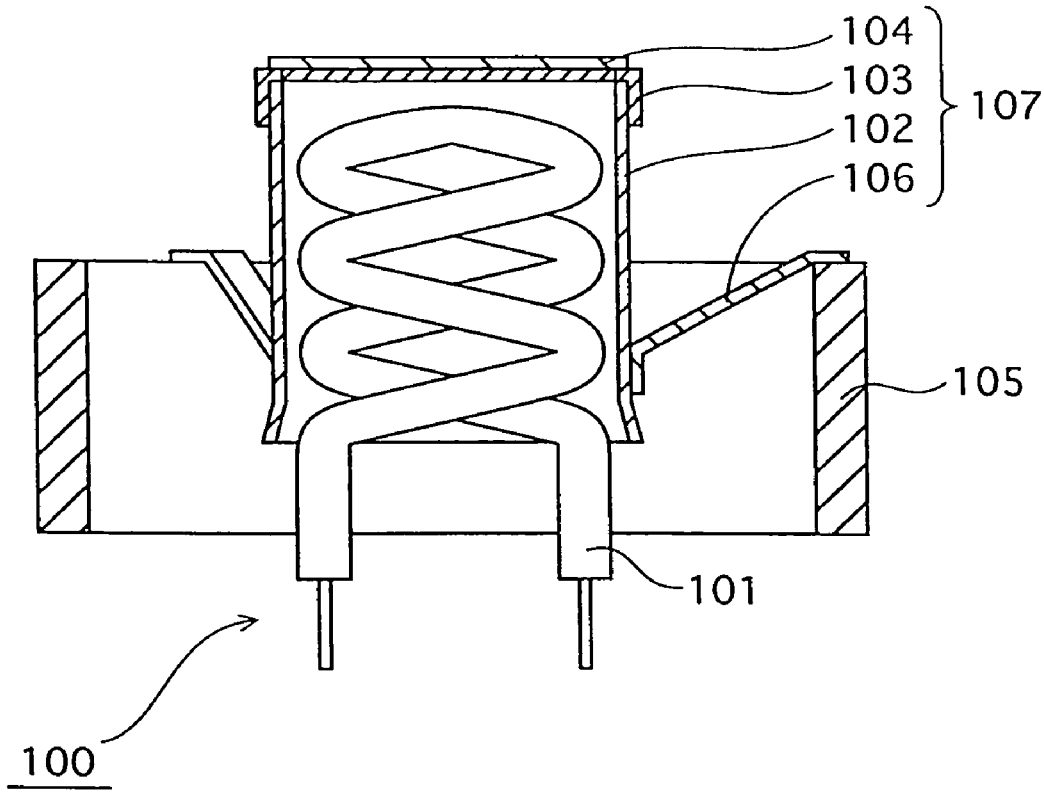
FIG. 1 PRIOR ART
FIG. 1 shows a conventional cathode body.
Figure 2:
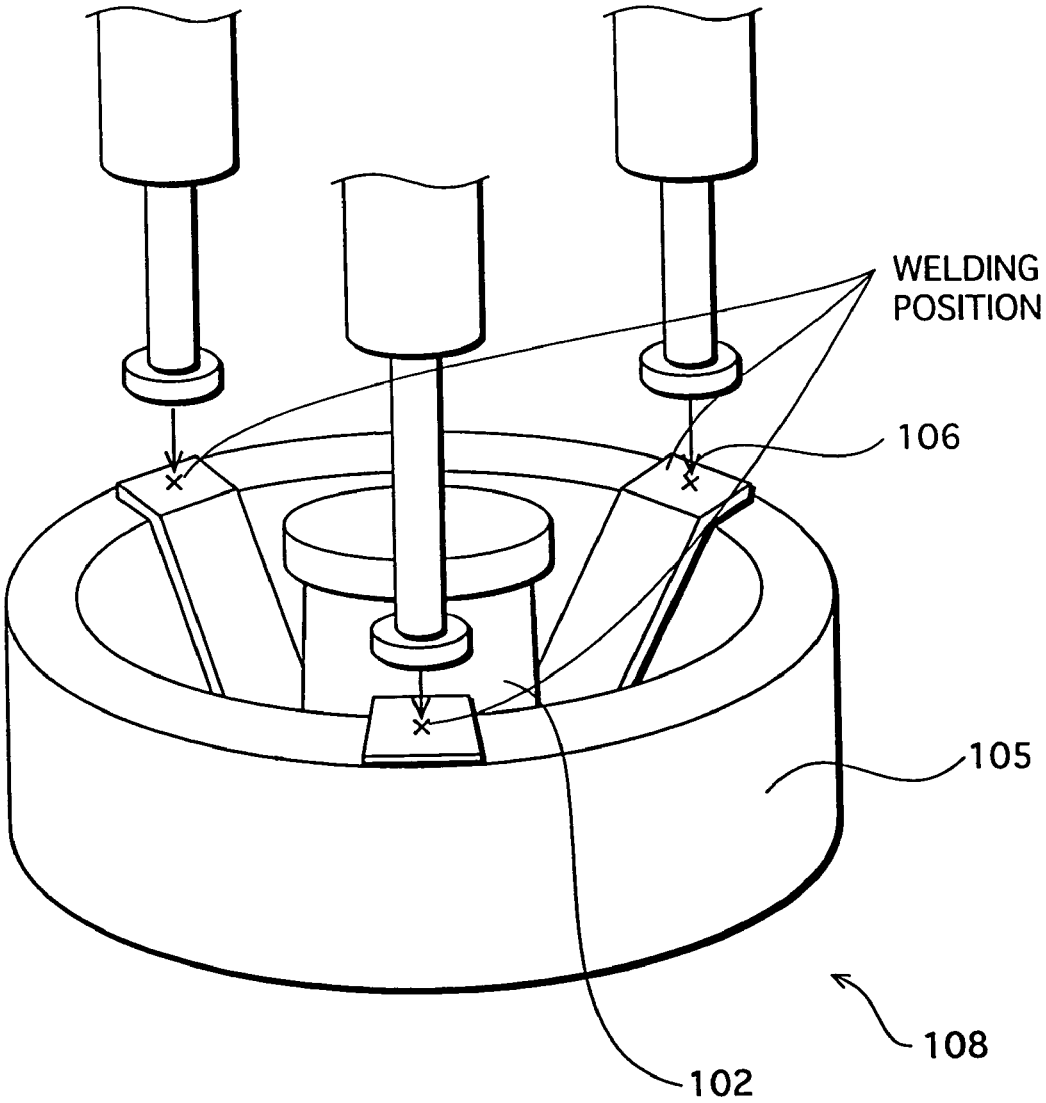
FIG. 2 shows a conventional welding process.
Figure 3:
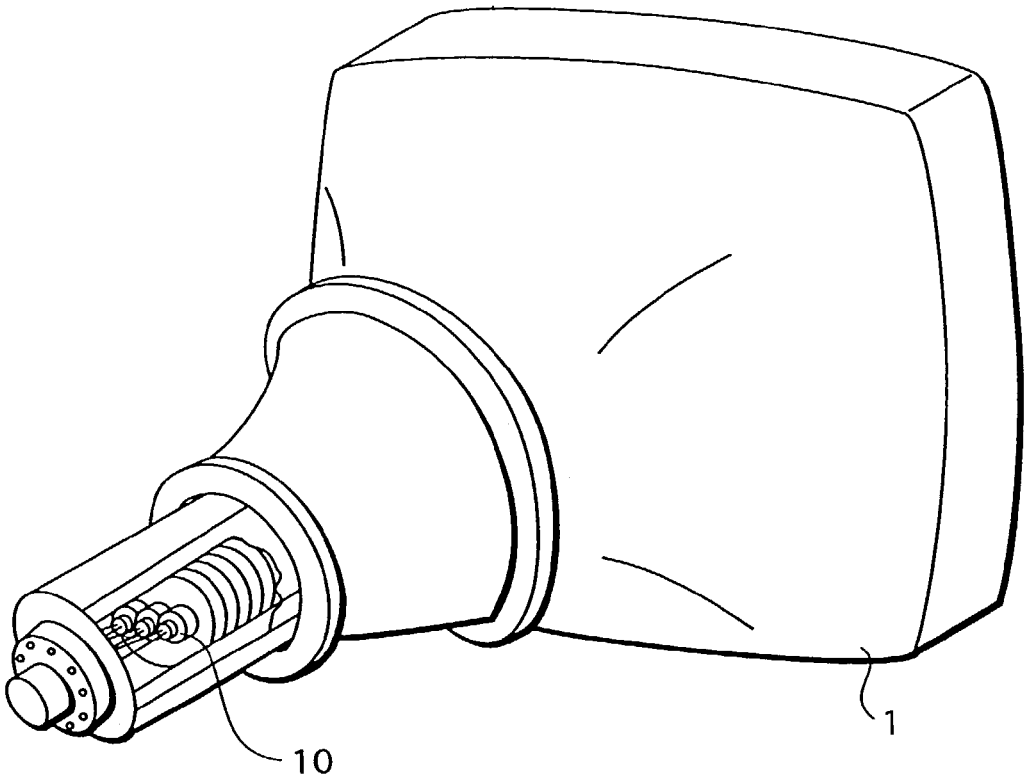
FIG. 3 shows a position of a cathode body in a cathode-ray tube in Embodiment 1.

As shown in FIG. 3, a cathode body 10 is embedded in an electronic gun of a cathode-ray tube 1.

Figure 4:
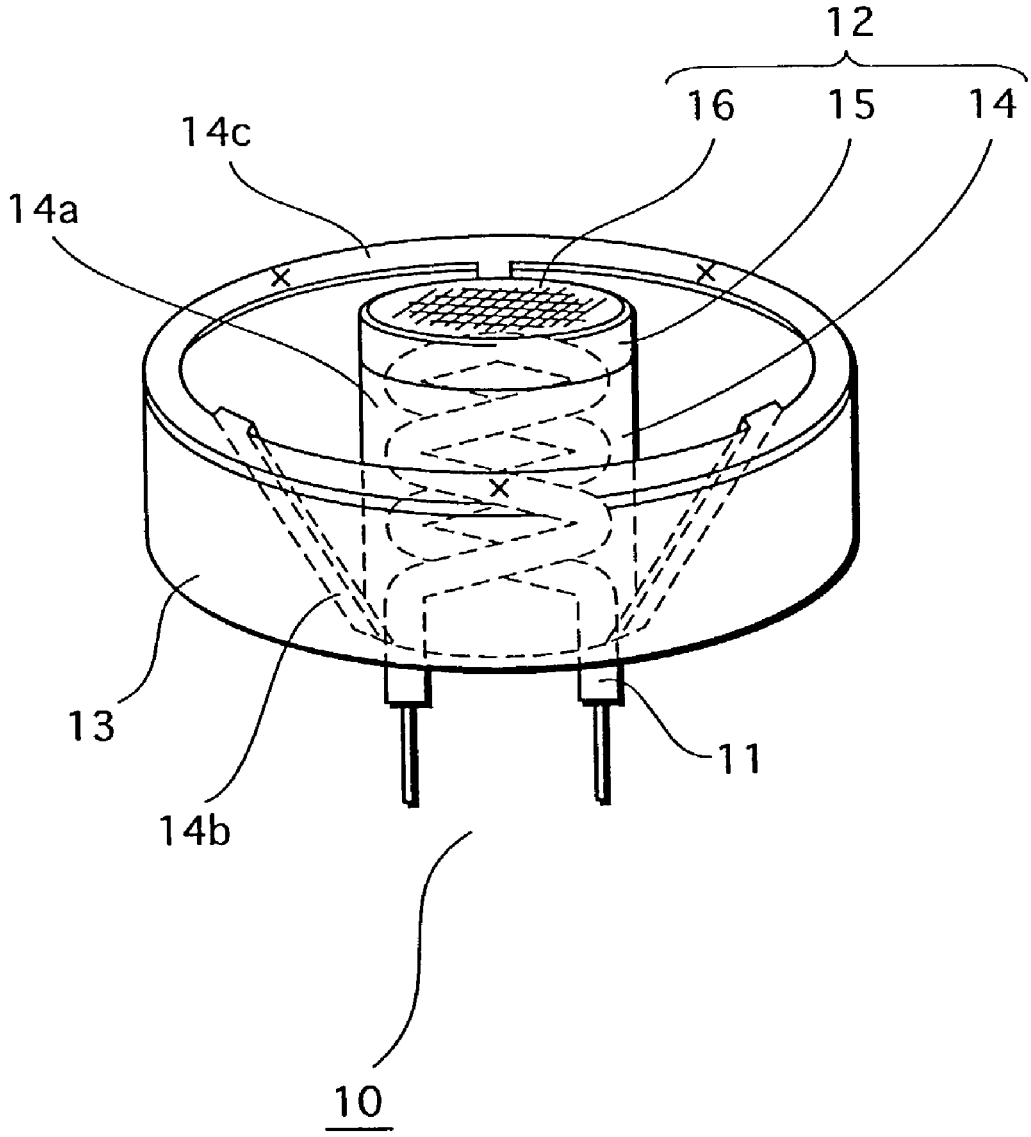
FIG. 4 shows the construction of the cathode body in Embodiment 1.

As shown in FIG. 4, the cathode body 10 includes a heater 11 at its center. A cathode body member 12 surrounds the heater 11. A cylindrical cathode holding member 13, which is an example of a supporting member, surrounds the cathode body member 12. As shown in FIG. 4, the cathode holding member 13 is fixed to the cathode body member 12 by the following method.

The cathode body member 12 is constructed as follows. A cap member 15, which is made of Ni at a purity degree of 99.9%, is fitted on an end of a cylindrical cathode sleeve structure 14 and welded to the cathode sleeve structure 14. A heater 11 is housed in the cathode sleeve structure 14. An electron emission material layer 16, which is made of an alkaline earth metal that has BaO (barium oxide) as main component, is formed on an outer surface of the cap member 15.

More specifically, three cathode sleeve supporting members 14*b*, which are examples of thin-plate supporting members, extend radially from a lower end of a cylindrical heater case member 14*a* that is an example of a heater case and is made of Ni at a purity degree of 99.9%. Each end of the extending cathode sleeve supporting members 14*b* is connected to a ring-shaped outer linkage member 14*c* that is an example of a linkage member. The outer linkage member 14*c* and the cathode holding member 13 are spot-welded together at three spots.

The inner surface of the heater case member 14*a* has been baked to be blacked.

The purpose of blacking the inner surface of the heater case member 14*a* is to facilitate absorption of heat coming from the heater, and enable the cathode to operate with a small amount of power provided by the heater.

Each cathode sleeve supporting member 14*b* extends from the heater case member 14*a* and is bent at its root toward the cap member 15 at an acute angle.

When viewed downward from any point on an extension of the axis of the cylindrical cathode body member 12, each adjacent pair of the cathode sleeve supporting members 14*b* forms an angle of 120°.

The shape of the outer linkage member 14*c* substantially matches the cross-sectional profile of the cathode holding member 13. The outer linkage member 14*c* and the cathode holding member 13 are spot-welded together at three spots (indicated by the signs "X" in FIG. 4).

The cylindrical heater case member 14*a,* cathode sleeve supporting members 14*b,* and outer linkage member 14*c* are formed as one piece by, for example, pressing or stamping a thin Ni plate.

That is to say, the construction of these members is different from the conventional technique in which both ends of each of three supporting members are welded to the cathode sleeve and the cathode holding member, respectively.

The outer linkage member 14*c* restricts the motion of the cathode sleeve supporting members 14*b.*

For example, when an external force is applied to any of three cathode sleeve supporting members 14*b,* the outer linkage member 14*c* distributes the external force to the other cathode sleeve supporting members 14*b.* As understood from this, the construction enhances the tolerance of cathode sleeve supporting members 14*b* to the external force.

Also, with the construction in which the outer linkage member 14*c* substantially matches the cross-sectional profile of the cathode holding member 13 in shape, it is possible to weld the outer linkage member 14*c* and the cathode holding member 13 in so far they are concentric. That is to say, even if the outer linkage member 14*c* and the cathode holding member 13 shift from each other circumferentially, a welding defect does not occur since welding areas are ensured.

Production Method

Now, a method of producing the cathode body 10 in Embodiment 1 will be described.

Figure 5A:
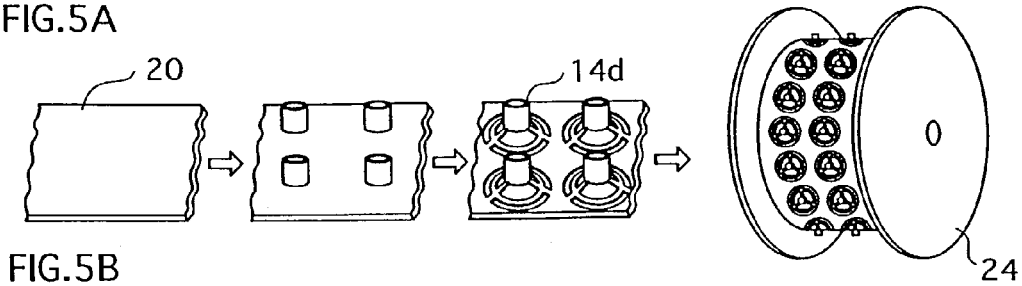
FIG. 5A shows the cathode sleeve substrate forming process.

The first process in producing the cathode body 10 is a cathode sleeve substrate forming process in which a plurality of three-dimensional, cathode sleeve interim bodies 14*d,* which will be described later, are formed on a thin Ni belt 20, and wound around a bobbin 24 (see FIG. 5A).

Figure 5B:
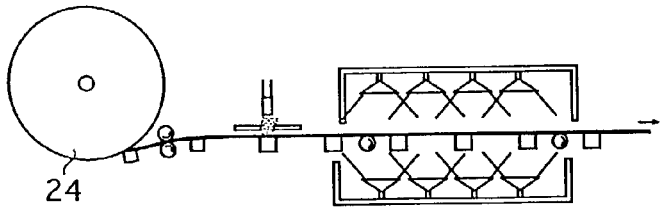
FIG. 5B shows the baking/blacking process.

The next process is a baking/blacking process in which an inner surface of an interim body of the cylindrical heater case member 14*a* for housing the heater is blacked (see FIG. 5B).

Figure 5C:
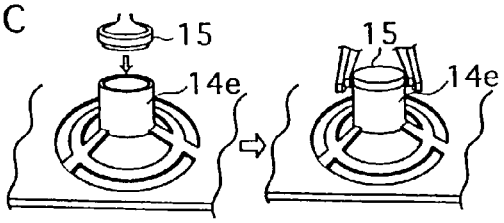
FIG. 5C shows the first welding process.
Figure 5D:
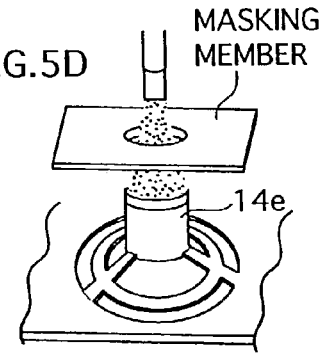
FIG. 5D shows the layer forming process.

The baking/blacking process is followed by a first welding process in which the cap member 15 is welded to the interim body of the cylindrical heater case member 14*a* at the opening thereof (see FIG. 5C). After this, in a layer forming process, the electron emission material layer 16 is formed by spraying an electron emission material onto an outer surface of the cap member 15 (see FIG. 5D).

Figure 5E:
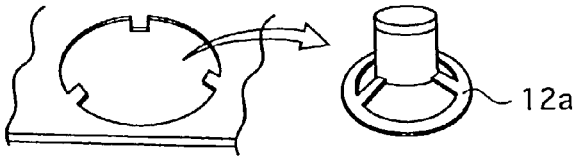
FIG. 5E shows the separation process.
Figure 5E:
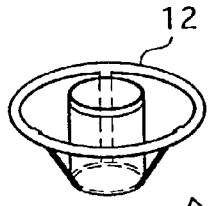

The layer forming process is followed by a separation process in which the parts to be used as the cathode bodies 10 are separated from the Ni belt (see FIG. 5E).

That is to say, the above processes before the separation process have been performed while the objects of the processes are held in the Ni belt.

Figure 5F:
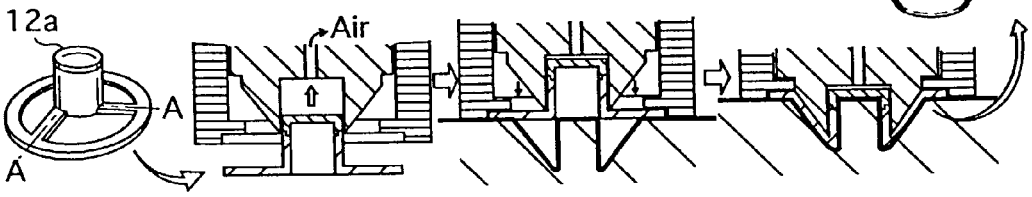
FIG. 5F shows the bending process.

After the separation process, the cathode sleeve supporting members 14*b* are bent to generate the cathode body member 12 in a bending process (see FIG. 5F). This is followed by a second welding process in which the cathode body member 12 and the cathode holding member 13 are welded together (see FIG. 5G).

Figure 5G:
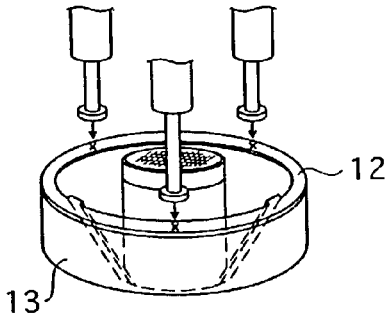
FIG. 5G shows the second welding process.
Figure 5H:
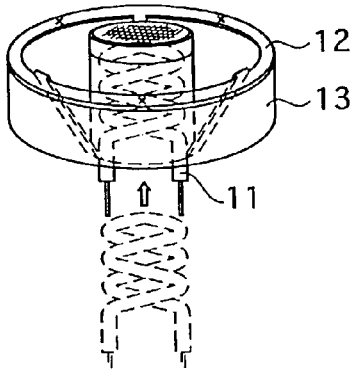
FIG. 5H shows the heater welding process.

In the next process, a heater welding process, the heater is inserted into the cathode sleeve structure 14, and the heater and the cathode sleeve structure 14 are welded together to form the cathode body 10 (see FIG. 5H).

Now, each process will be detailed.

1. Cathode Sleeve Substrate Forming Process

First, a belt that is 0.1 mm thick and made of Ni at a purity degree of 99.9% is pressed by, for example, deep drawing to form a plurality of cup-shaped protrusions. The tops of the protrusions are then cut to make openings. This forms bodies (hereinafter referred to as heater case member interim bodies 14*e*) that are to become the heater case members 14*a* later.

Portions of the Ni belt surrounding (i) bodies (hereinafter referred to as supporting member interim bodies 14*f*) that are to become the cathode sleeve supporting members 14*b* later and (ii) bodies (hereinafter referred to as outer linkage member interim bodies 14*g*) that are to become the outer linkage members 14*c* later are stamped out to form a plurality of bodies (hereinafter referred to as cathode sleeve interim bodies 14*d*) that are to become the cathode sleeve structures 14 later. In each cathode sleeve interim body 14*d,* the heater case member interim body 14*e,* the supporting member interim bodies 14*f,* and the outer linkage member interim body 14*g* are formed as one piece.

This process of forming the cathode sleeve interim bodies 14*d* on a thin metal belt is referred to as the cathode sleeve substrate forming process. Also, the thin metal belt on which the cathode sleeve interim bodies 14*d* are formed is referred to as a cathode sleeve substrate 22.

As shown in FIGS. 6A and 6B, three-dimensional heater case member interim bodies 14*e* have been made by deep drawing by the end of the cathode sleeve substrate forming process.

The cathode sleeve substrate 22 in which the plurality of cathode sleeve interim bodies 14*d* have been formed is wound in the bobbin 24 with such a tension as can maintain the shapes of the heater case member interim bodies 14*e,* the supporting member interim bodies 14*f,* and the outer linkage member interim bodies 14*g*. The bobbin 24 holding the cathode sleeve substrate 22 is then stored and transferred.

2. Baking/Blacking Process

In the baking/blacking process, inner surfaces of the heater case member interim bodies 14*e* are blacked as follows.

Figure 7:
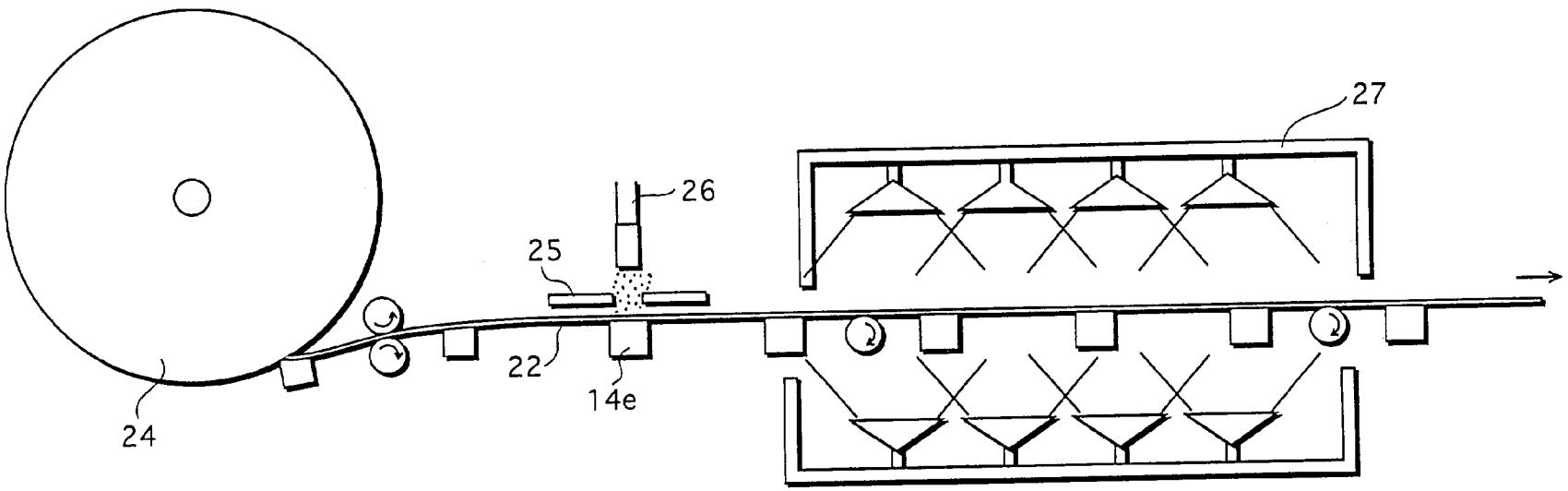
FIG. 7 shows the baking/blacking process.

The cathode sleeve substrate 22 is unwound from the bobbin 24. Then, as shown in FIG. 7, tungsten-alumina powder is injected from an injection nozzle 26 while certain portions of the cathode sleeve substrate 22 are covered by masking material 25 so that the tungsten-alumina powder is applied only to an inner surface of each heater case member interim body 14*e*. The applied powder is then baked in an electric furnace 27 and the inner surface of each heater case member interim body 14*e* is blacked.

More particularly, the tungsten-alumina powder is composed of a high-melting-point metal and an inorganic binder, where the high-melting-point metal is composed of tungsten powder having average particle diameter of 1 μm and sintered alumina having average particle diameter of 5–10 μm.

It should be noted here that if the main component of the cathode sleeve substrate 22 is chrome, the inner surface of each heater case member interim body 14*e* can be blacked only by baking, without applying the tungsten-alumina powder.

3. First Welding Process

Figure 8:
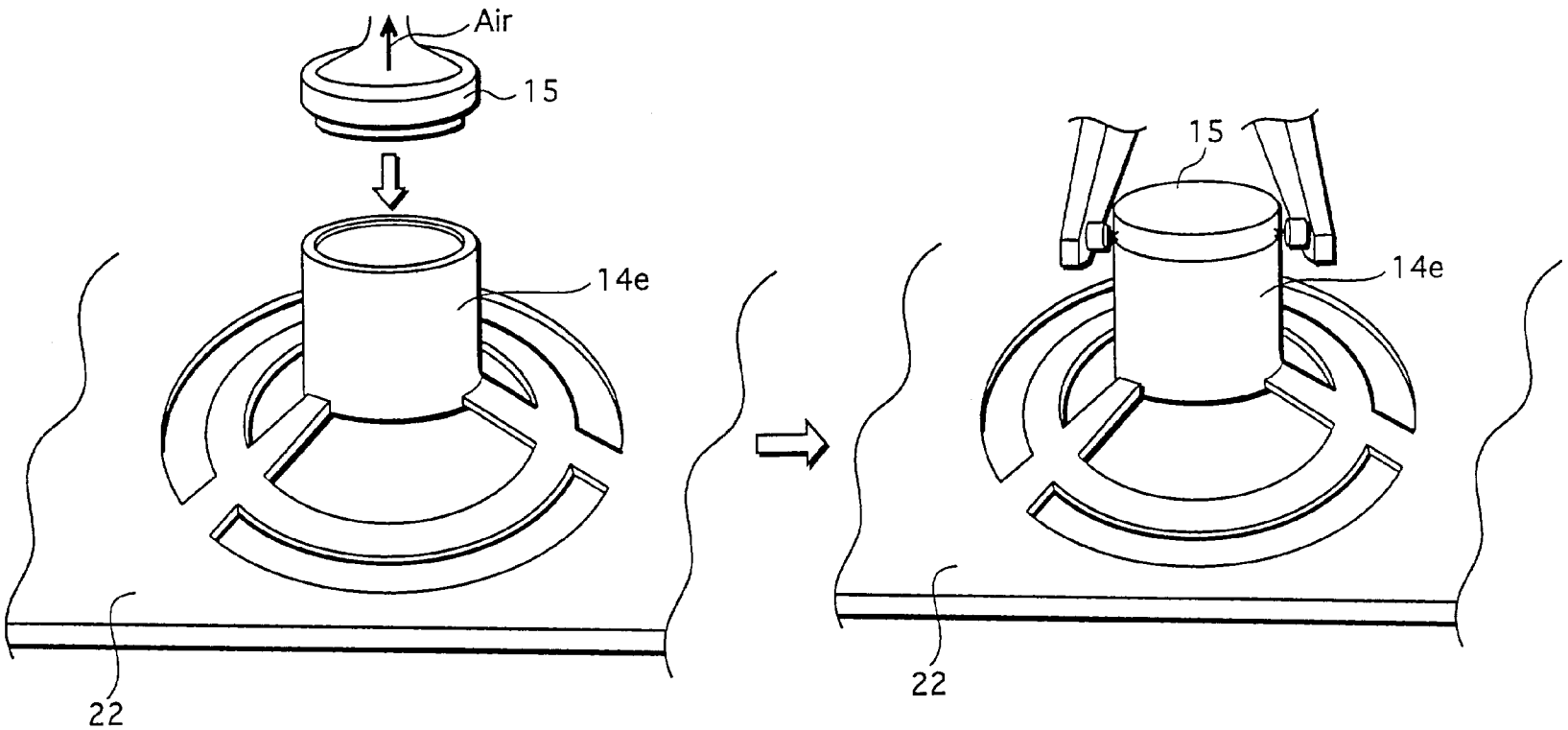
FIG. 8 shows the first welding process.

In the first welding process, as shown in FIGS. 8A and 8B, the cap member 15 made of Ni and a small amount of reducing agent is slipped over an end of the heater case member interim body 14*e* and spot-welded to the heater case member interim body 14*e*.

The first welding process is performed while the cathode sleeve interim bodies 14*d* is integral with the cathode sleeve substrate 22.

4. Layer Forming Process

In the layer forming process, an oxide cathode, namely the electron emission material layer 16 is formed by, for example, spraying an alkaline earth metal that is an electron emission material, onto a masking material sheet so that the electron emission material passes through an opening of the masking material sheet and heaps on the outer surface of the cap member 15.

5. Separation Process

Figure 9A:
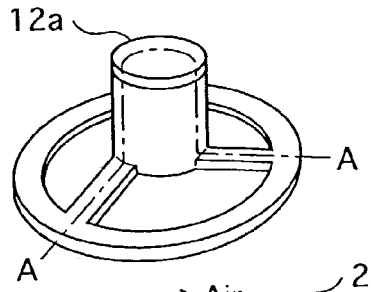
FIG. 9A shows an interim product immediately before it is subjected to the bending process in Embodiment 1.

In the separation process, as shown in FIG. 5E, the cathode sleeve substrate 22 is cut along a parting line 21 indicated in FIG. 6A to separate an interim product 12*a* shown in FIG. 9A from the cathode sleeve substrate 22.

It is desirable from the viewpoint of preventing deformation of the cathode sleeve supporting members 14*b* that if the total number of processes is expressed by "n", the separation process should be performed in $n/2^{th}$ process or onward when n is an even number, and in $(n+1)/2^{th}$ process or onward when n is an odd number, that is, in the latter half of the whole process.

6. Bending Process

In the bending process, first the interim product 12*a* shown in FIG. 9A is set in a depression of a bending jig 28*a* in which a negative pressure is applied.

Figure 9B:
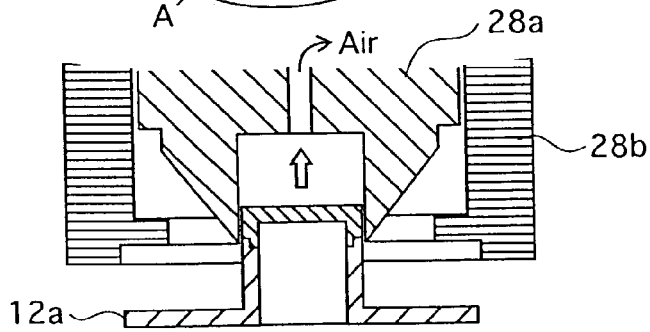
FIG. 9B shows how the interim product is set in a bending jig in the bending process in Embodiment 1.
Figure 9C:
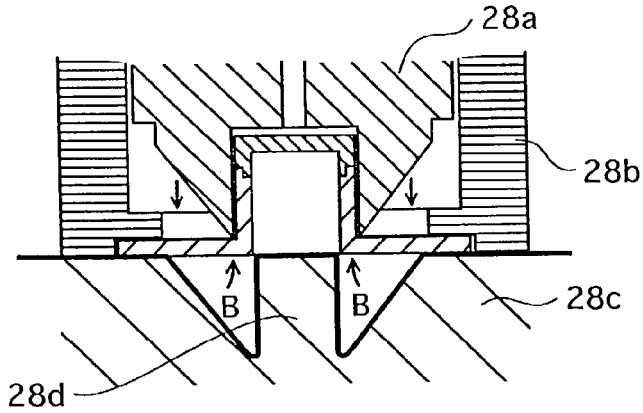
FIG. 9C shows how the bending jig moves in the bending process in Embodiment 1.
Figure 9D:
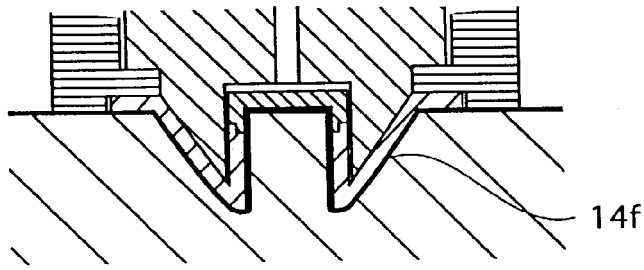
FIG. 9D shows how the bending jig moves and the interim product is shaped in the bending process in Embodiment 1.

It should be noted here that the cross-sectional view of the interim product 12*a* shown in FIGS. 9B through 9D is taken substantially along line A—A of FIG. 9A.

As shown in FIG. 9C, the bending jig 28*b* is lowered to a position where it contacts the bending jig 28*c*, by keeping the relative positions between the bending jigs 28*a* and 28*b* unchanged.

Figure 9E:
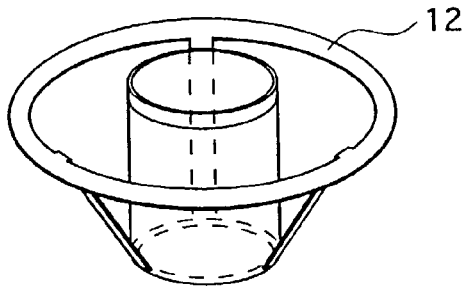
FIG. 9E shows the shape of the interim product after the bending process in Embodiment 1.

As shown in FIG. 9D, the bending jig 28*a* is then further lowered, so that the interim product 12*a* is lowered, a protrusion 28*d* of the bending jig 28*c* is inserted into the heater case member 14*a* of the interim product 12*a*, and the supporting member interim bodies 14*f* are bent at their roots toward the cap member 15 at acute angles. As a result, the cathode body member 12 shown in FIG. 9E is formed.

7. Second Welding Process

In the second welding process, the ring-shaped outer linkage member 14*c* of the cathode body member 12 and the cylindrical cathode holding member 13 are welded together.

First, as shown in FIG. 5G, the ring-shaped outer linkage member 14*c* of the cathode body member 12 is placed on an end of the cylindrical cathode holding member 13 so that the ring shape of the outer linkage member 14*c* substantially overlaps the cross-sectional profile of the cathode holding member 13. The outer linkage member 14*c* and the cathode holding member 13 are spot-welded together at three spots.

With this operation, the ring-shaped outer linkage member 14*c* of the cathode body member 12 and the cylindrical cathode holding member 13 are fixed to each other by welding.

As described above, in the second welding process of Embodiment 1, the ring-shaped outer linkage member 14*c* is spot-welded to a top end of the cathode holding member 13, while in the conventional method, free ends of the three supporting members 106 are spot-welded onto a top end of the cathode holding member 105.

With the above-described construction of Embodiment 1, even if the cathode body member 12 and the cathode holding member 13 shift from each other due to rotation, the outer linkage member 14*c* always overlaps the top end of the cathode holding member 13. This prevents occurrence of welding defects since welding areas are ensured.

8. Heater Welding Process

As shown in FIG. 5H, in the heater welding process, the heater 11 is inserted into the cathode sleeve structure 14 of the cathode body member 12, and the heater 11 is fixed to the cathode body member 12 by welding.

This completes the cathode body 10.

As described above, the cathode body 10 is produced in eight processes. Of these, in the first five processes including the separation process, the object of the processes is stored and transferred as the cathode sleeve substrate 22 which is in a form in which the supporting member interim bodies 14*f*, which have a weak construction, are less prone to being directly applied external forces.

That is to say, even if no special storage jig or transfer jig is used, the weak supporting member interim bodies 14*f* and cathode sleeve supporting members 14*b* are prevented from being deformed by external forces. In such arrangements, off course, the object component is not mounted on such a special storage jig or transfer jig in the baking/blacking process or a welding process.

A number of operations of catching hold of a component or placing it on a certain place are performed in the conventional production method. In contrast, the production method of Embodiment 1 hardly requires such operations. As a result, the present production method can prevent the cathode sleeve supporting members 14*b*, which are prone to being deformed during such operations, from being deformed.

Further, even after the interim product 12*a* is separated in the separation process, an external force exerted on a cathode sleeve supporting member 14*b* is distributed to the other supporting members 14*b* by the outer linkage member 14*c* to which the three supporting members 14*b* are connected. Accordingly, this construction prevents the cathode sleeve supporting members 14*b* from being deformed by external forces during storage or transfer.

Yield Improvement Confirmation Test

Now, the cathode body 10 having been produced through the above-described processes and having the above-described construction will be discussed in terms of the yield.

The inventors of the present invention made a prototype of the cathode body 10 through the processes in Embodiment 1 to have the unique construction, and checked the yield of the prototype in terms of: (i) deformation of the cathode sleeve supporting members 14*b* in the baking/blacking process; (ii) deformation of the cathode sleeve supporting members 14*b* to the level of unusable state that occurs in the second welding process when the cathode body member 12 is mounted on a welding apparatus to be welded to the cathode holding member 13; (iii) deformation of the cathode sleeve supporting members 14*b* during the welding in the second welding process; and (iv) welding defect caused during the welding in the second welding process.

The specifications of the prototype of the cathode body 10 are as follows.

The cathode sleeve structure 14 is formed using a Ni plate that is 0.05 mm thick.

The cylindrical heater case member 14*a* has an outer diameter of 1.6 mm. The cathode sleeve supporting member 14*b* is 0.3 mm wide and 3 mm long. The ring-shaped outer linkage member 14*c* is 0.2 mm wide.

The cap member 15 is slipped over and welded to the cathode sleeve structure 14.

The specifications of a test sample of the conventional cathode body 100 that was prepared for the sake of comparison are as follows.

The sample of the conventional cathode body 100 has the cathode sleeve 102 and the cathode sleeve supporting members 106 as separate components, and does not have an equivalent of the ring-shaped outer linkage member 14*c* shown in FIG. 4. The cathode sleeve supporting member 106 is 0.3 mm wide and 2.7 mm long. The other components are made of the same materials and have the same dimensions as the prototype of the cathode body 10.

The following Table 1 shows the results of the yield improvement confirmation test the inventors conducted.

TABLE 1

| | Yield of (i) | Yield of (ii) | Yield of (iii) | Yield of (iv) | Total yield of (i)–(iv) |
|---|---|---|---|---|---|
| Cathode body of present invention | 99% | 99% | 97% | 100% | 95.1% |
| Conventional cathode body | 71% | 88% | 92% | 96% | 55.2% |

As Table 1 indicates, for each of the items (i) to (iv), the cathode body 10 in Embodiment 1 is superior to the conventional cathode body 100 in yield.

Especially, the effect of the cathode body 10 for preventing (i) deformation of the cathode sleeve supporting members 14*b* in the baking/blacking process is prominent.

The reason why the yield of (iv) welding defect in the welding process has been improved in the cathode body 10 of Embodiment 1 is considered as follows. Conventionally, the cathode sleeve supporting members 14*b* can be welded only at their ends. In contrast, in the cathode body 10 of Embodiment 1, welding can be performed on the whole area of the ring-shaped outer linkage member 14*c*. With this construction, even if a welding position on the outer linkage member 14*c* shifts circumferentially, a welding defect does not occur.

Also, the total yield of the items (i) to (iv) is 95.1% in the cathode body 10 in Embodiment 1 and 55.2% in the conventional cathode body 100. That is to say, the cathode body 10 and its production method in Embodiment 1 provide an approximately double improvement in yield.

Also, with such a construction and production method, even if an external force is exerted on a cathode sleeve supporting member 14*b* in a production process of the cathode body 10, the external force is distributed to the other supporting members 14*b* by the outer linkage member 14*c*, and the cathode sleeve supporting members 14*b* are prevented from being deformed by external forces.

In the present production method, interim products are transferred in the form of the cathode sleeve substrate 22 which is less prone to being directly applied external forces. With such arrangements, the weak cathode sleeve supporting members 14*b* constituting the cathode sleeve substrate 22 are prevented from being deformed by external forces. This improves the cathode body 10 in yield.

Variations

In Embodiment 1, the cathode sleeve supporting members 14*b* are made from plane plates. Not limited to this, the cathode sleeve supporting members 14*b* may be sticks, with their cross-sectional profile substantially being a circle.

In Embodiment 1, the top end of the cathode holding member 13 is circular, when viewed from above. Not limited to this, the top end of the cathode holding member 13 may be, for example, rectangular. Note that in correspondence with adoption of the shape, the shape of the outer linkage member 14*c* of the cathode sleeve structure 14 should also be rectangular.

Figure 10:
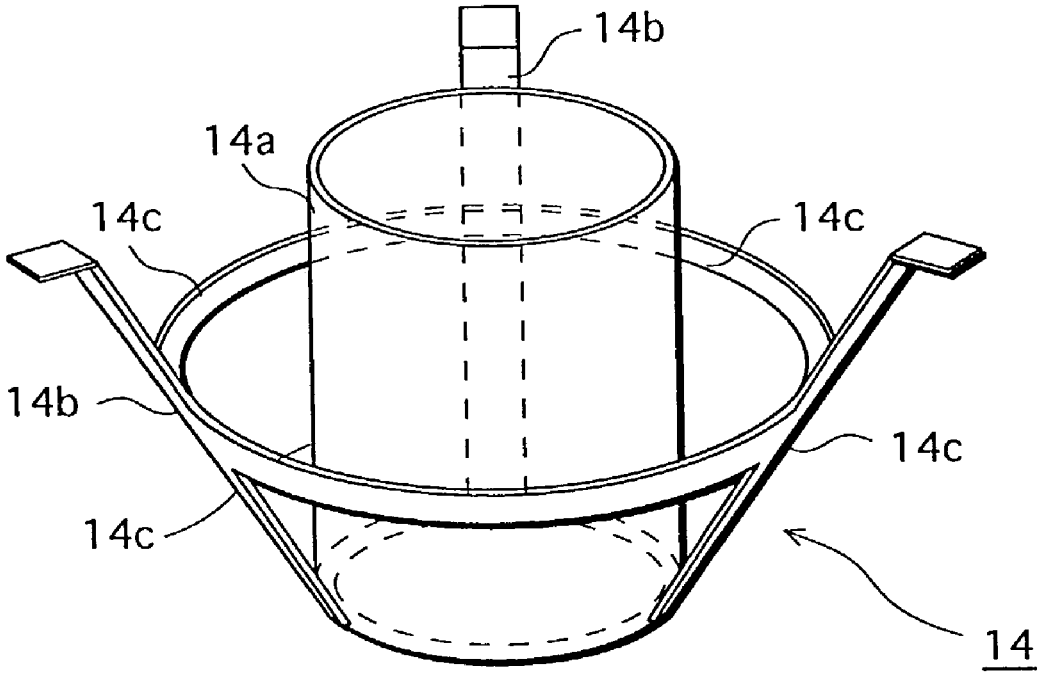
FIG. 10 shows a variation of the outer linkage member 14*c* in the position at which it is formed.

In Embodiment 1, the cathode holding member 13 and the outer linkage member 14*c* are welded together. Not limited to this, the outer linkage member 14*c* may be formed to connect each cathode sleeve supporting member 14*b* at some midpoint thereof as shown in FIG. 10, not at the end. In this case, the cathode holding member 13 is welded to each end of the cathode sleeve supporting members 14*b*.

The above-mentioned construction has the same effect, provided by the outer linkage member 14*c*, of distributing an external force exerted on a cathode sleeve supporting member 14*b* to the other cathode sleeve supporting members 14*b*, as is the case with Embodiment 1. However, the above-mentioned construction does not have the effect of preventing a welding defect from occurring when the welding position is shifted. As a result, the relative position between the cathode sleeve supporting members 14*b* and the cathode holding member 13 should be controlled strictly.

In Embodiment 1, each of the extending cathode sleeve supporting members 14*b* is connected to the outer linkage member 14*c*. However, not limited to this, at least a pair of cathode sleeve supporting members 14*b* adjacent to each other, among a plurality of cathode sleeve supporting members 14*b*, may be connected to each other by the outer linkage member 14*c*.

For example, suppose that three cathode sleeve supporting members 14*b*1, 14*b*2, and 14*b*3 are provided. Then, the cathode sleeve supporting members 14*b*1 and 14*b*2 are connected together by the outer linkage member 14*c*, but the cathode sleeve supporting member 14*b*3 is not connected to any other cathode sleeve supporting members.

In this case, if an external force is exerted on any of the cathode sleeve supporting members 14*b*1 and 14*b*2, the force is distributed to the other supporting member, and therefore the supporting members are prevented from being deformed.

In this case, the resistance of the cathode sleeve supporting member 14*b*3 to the deformation is the same as the conventional one. However, since the resistance to the deformation of the other two cathode sleeve supporting members has improved, the resistance to the deformation of the cathode sleeve supporting members has improved as a whole.

Figure 11:
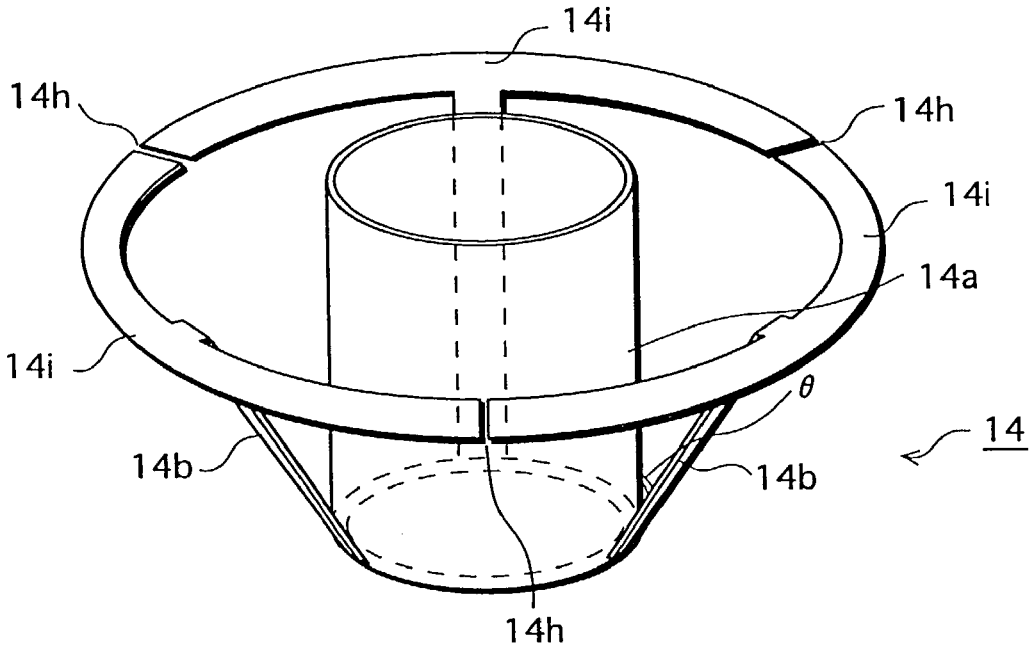
FIG. 11 shows a variation of the outer linkage member 14*c* in the shape.

In Embodiment 1, the outer linkage member 14*c* is shaped like a ring. Not limited to this, the ring-shaped outer linkage member 14*c* may be divided into three pieces that correspond to the three cathode sleeve supporting members 14*b*, respectively, as shown in FIG. 11.

For the sake of conveniences, a gap between each pair of such pieces of the ring-shaped outer linkage member 14*c* is referred to as a slit 14*h*, and such a piece of the ring-shaped outer linkage member 14*c* is referred to as an extended outer linkage member 14*i*.

With this construction, when an external force in a certain range of force levels is exerted on a cathode sleeve supporting member 14*b*, the cathode sleeve supporting member 14*b* is elastically deformed, and an extended outer linkage member 14*i* connected to the cathode sleeve supporting member 14*b* comes into contact with the other extended outer linkage members 14*i*. As a result of this, the external force is distributed to the other cathode sleeve supporting members 14*b*.

After the external force is removed, the cathode sleeve supporting member 14*b* and the corresponding extended outer linkage member 14*i* return to the original positions.

The inventors of the present invention found that the above-stated effect is obtained when the slit 14*h* is 0.5 mm in width.

Also, with the above-described construction, since the cathode sleeve supporting members 14*b* do not connect to each other due to gaps between the extended outer linkage members 14*i*, when the cathode sleeve supporting members 14*b* and the extended outer linkage members 14*i* are formed, they are less prone to having defects such as a crack even if they have some plastic deformation. This reduces restrictions imposed on the shapes of these members in the formation process.

More particularly, when, as in Embodiment 1, the cylindrical heater case member 14*a*, cathode sleeve supporting members 14*b*, and outer linkage member 14*c* are formed as one piece, it is impossible to further decrease a bending angle θ (see FIG. 11). However, with this varied construction in which each pair of a cathode sleeve supporting member 14*b* and an extended outer linkage member 14*i* can relatively move freely thanks to the slit 14*h*, each cathode sleeve supporting member 14*b* can be bent as desired. It is therefore possible to have an acuter bending angle θ.

In connection with this variation, the ring-shaped outer linkage member 14*c* may not be completely separated into three pieces, but may have slits that stops halfway through the width so that pieces demarcated by the slits connect to each other.

In Embodiment 1, the ring-shaped outer linkage member 14*c* is spot-welded to a top end of the cathode holding member 13 at a plurality of spots. However, the ring-shaped outer linkage member 14*c* and the top end of the cathode holding member 13 may be welded over the whole circumference.

Figure 12:
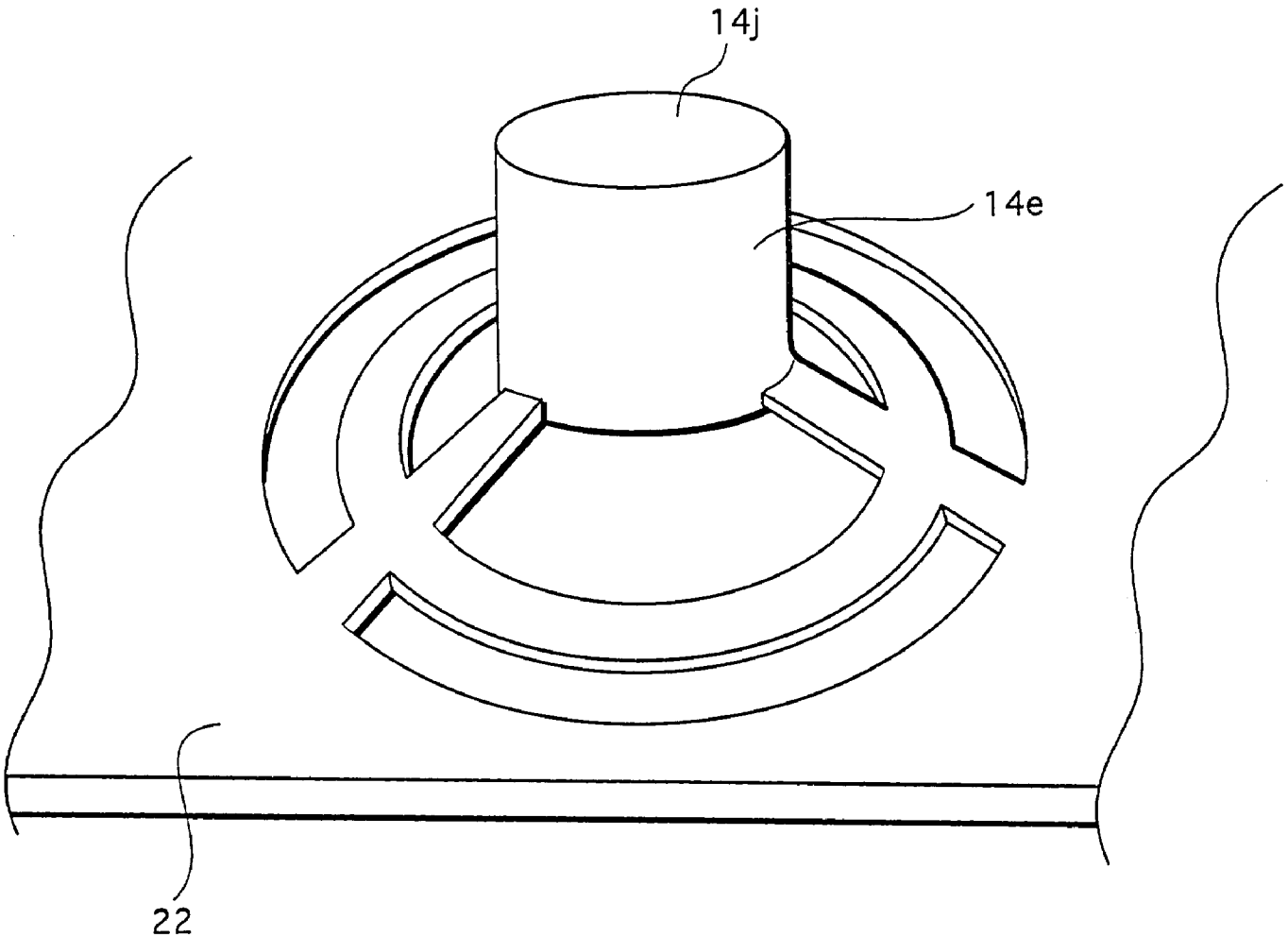
FIG. 12 shows a variation of the cathode sleeve substrate 22 in the shape.

In Embodiment 1, the cap member 15 is formed separately from the heater case member interim bodies 14*e*. However, the cap member 15 and the heater case member interim bodies 14*e* may be formed as one piece, which can be achieved by omitting the process of cutting the tops of the cut-shaped protrusions formed on the Ni belt, as shown in FIG. 12. That is to say, atop-surface member 14*j* functions as the cap member 15.

In this variation, the first welding process in which the cap member 15 is welded to the heater case member interim body 14*e* is not necessary. This further reduces the chance that the cathode sleeve supporting members 14*b* may be deformed.

In the description provided so far, the ring-shaped outer linkage member 14*c* and the cathode holding member 13 are welded together. Not limited to this, the following is possible, for example.

Figure 13:
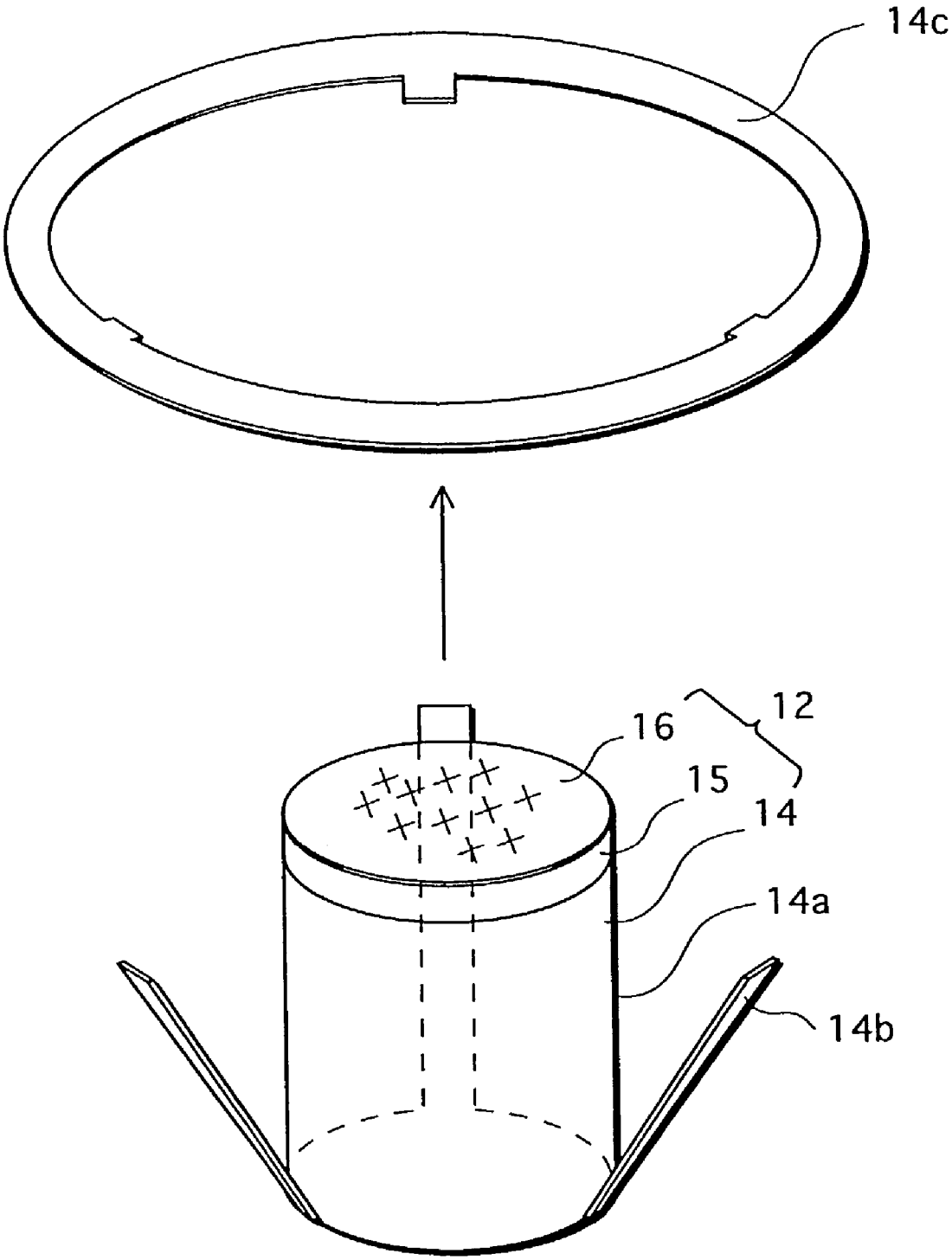
FIG. 13 shows a variation of the separation process for the cathode body.
Figure 14:
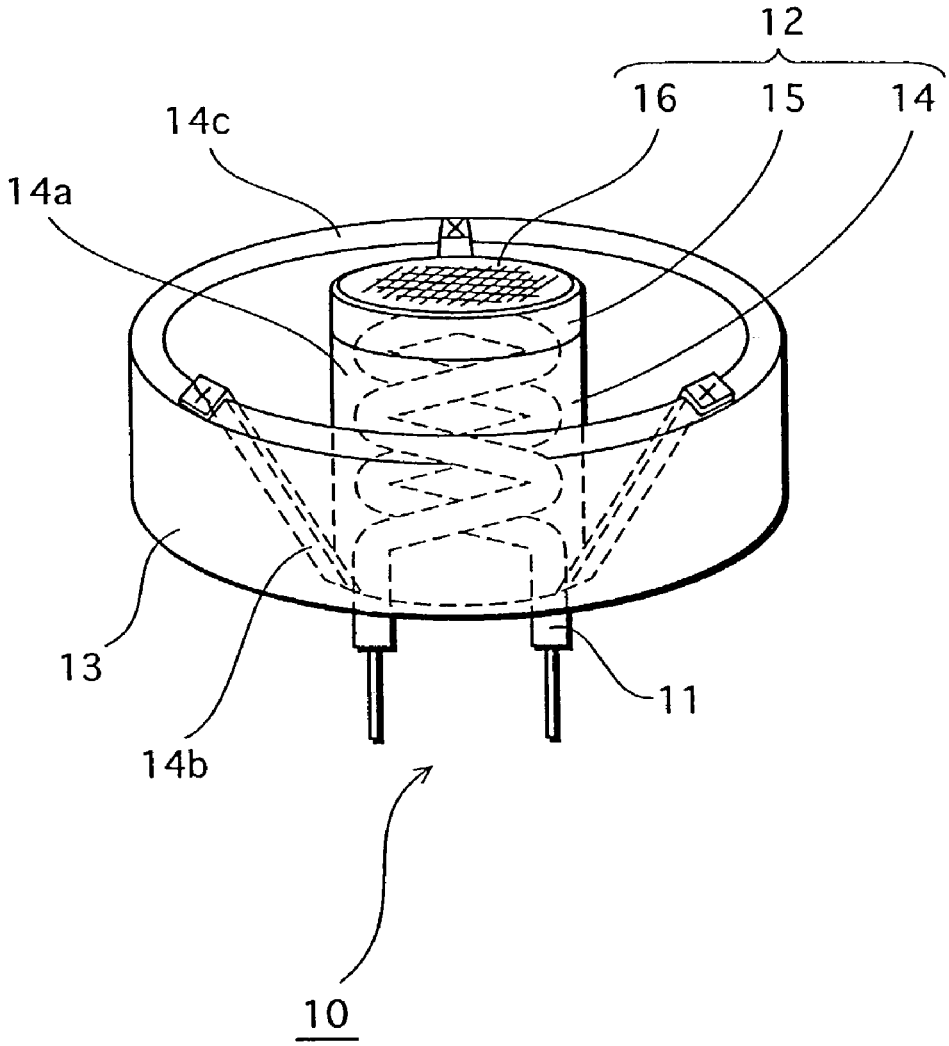
FIG. 14 shows a variation of the welding process for the cathode body.

As shown in FIG. 13, the following is performed immediately before the second welding process in which the cathode body member 12 and the cathode holding member 13 are welded together. The ring-shaped outer linkage member 14*c* is separated from the cathode body member 12 by cutting it near the boundary between the ring-shaped outer linkage member 14*c* and the cathode sleeve supporting members 14*b* so that one end of each cathode sleeve supporting member 14*b* is liberated. The liberated ends of the cathode sleeve supporting members 14*b* are then bent and welded to the top end of cathode holding member 13, as shown in FIG. 14.

In this way, the cathode sleeve supporting members 14*b* of the cathode sleeve structure 14 are welded to the cathode holding member 13.

In such a production method, although a process of cutting the outer linkage member 14*c* is additionally performed, a conventional welding apparatus can be used. Furthermore, since the cathode sleeve supporting members 14*b* are not liberated until immediately before the cathode body member 12 and the cathode holding member 13 are welded together, it is possible to protect the cathode sleeve supporting members 14*b* from deformation until immediately before the welding.

Figure 15:
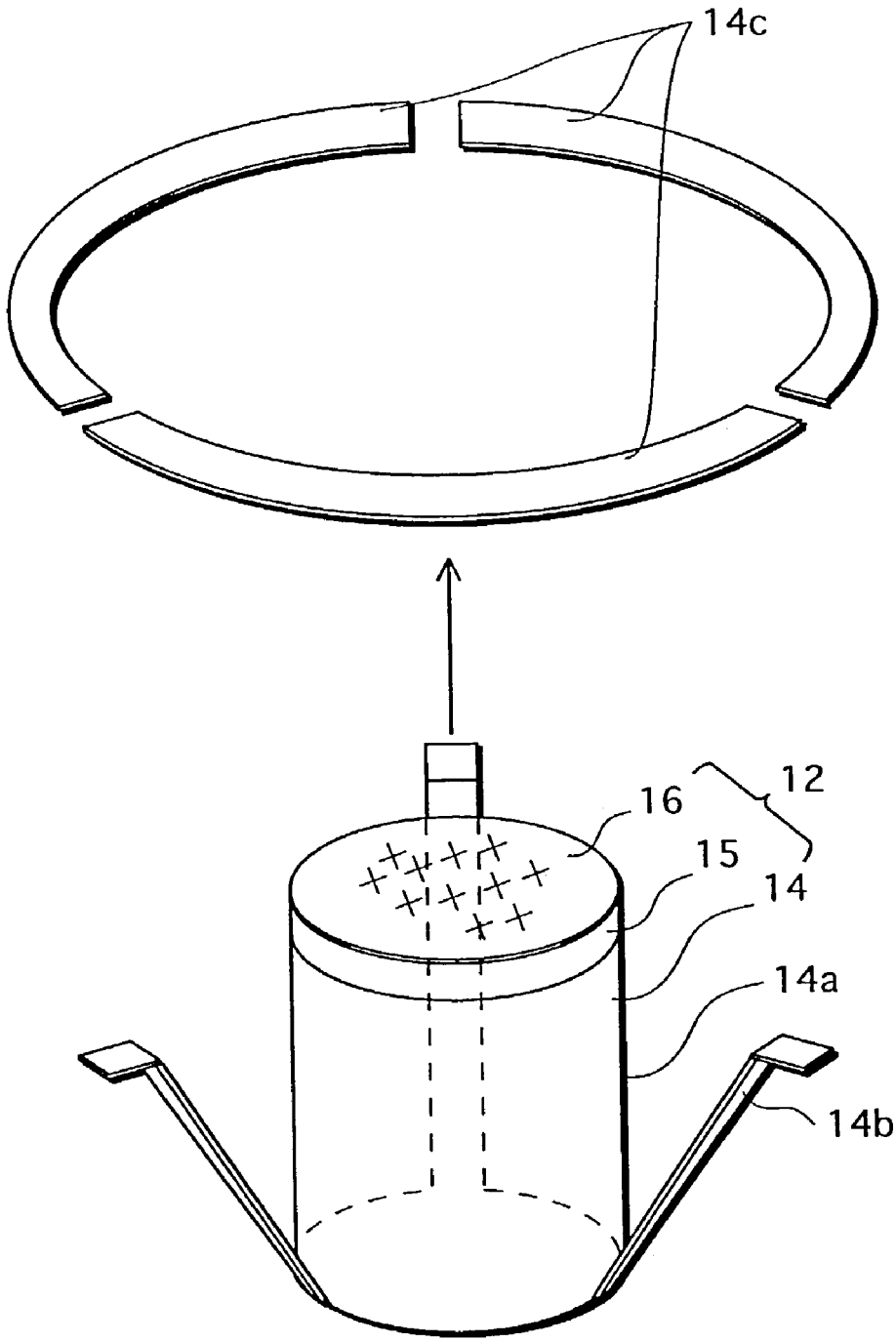
FIG. 15 shows a variation of the separation process for the cathode body.

In connection with this variation, the ring-shaped outer linkage member 14*c* may be cut as shown in FIG. 15, not like the way shown in FIG. 13. That is to say, the ring-shaped outer linkage member 14*c* may be cut so that portions of the outer linkage member 14*c* that are extensions of the cathode sleeve supporting members 14*b* are left. This eliminates the necessity of the process of bending the cathode sleeve supporting members 14*b*, further reducing the chance that the cathode sleeve supporting members 14*b* may be deformed.

In Embodiment 1, in the first five processes including the separation process among a total of eight processes, the cathode sleeve substrate 22 containing a plurality of cathode sleeve interim bodies 14*d* is stored and transferred. Not limited to this, the cathode sleeve interim bodies 14*d* may be separated from the cathode sleeve substrate 22 in the first process and then stored and transferred in the following processes, for example.

In this case, if an external force is exerted on a supporting member interim body 14*f* of a separated cathode sleeve interim body 14*d*, the external force is distributed to the other supporting member interim bodies 14*f* by the outer linkage member interim body 14*g* to which the three supporting member interim bodies 14*f* are connected and fixed. The supporting member interim body 14*f* is protected from deformation in this way.

In Embodiment 1, the cathode sleeve structure 14 is made of Ni at a purity degree of 99.9%. Embodiment 1 also provides particular dimensions of the cathode sleeve structure 14 and the cathode sleeve supporting members 14*b*, and a particular method of blacking that is used in the baking/blacking process. However, not limited to these particulars, the materials, dimensions or the baking/blacking method may be modified variously in so far as they are no worse than conventional ones in terms of the heat loss and the product quality, on condition that the heater case member 14*a,* the cathode sleeve supporting members 14*b,* and the outer linkage member 14*c* are formed as one piece.

The inventors of the present invention conducted a performance test on six electron guns in which six different cathode bodies are embedded, respectively, to detect materials, dimensions, and baking/blacking methods that can replace those disclosed in Embodiment 1, on condition that they are no worse than conventional ones in terms of the heat loss and the product quality.

The measurement object of each test is the cathode sleeves of two outer cathode bodies among three cathode bodies in each inline-type electron gun.

Specifications of Test Samples

1. Specifications of Conventional Cathode Body 100

Specifications of a conventional cathode body 100 prepared for the test are as follows.

The cylindrical cathode sleeve 102 is made of 20% of Cr (chromium) and 80% of Ni (nickel), has an outer diameter of 1.6 mm, and is 2.5 mm high and 0.04 mm thick. The cathode sleeve supporting member 106 is 2.5 mm long, 0.3 mm wide, and 0.1 mm thick.

The cathode sleeve supporting member 106 is made of Ni—Fe and is welded to the cathode sleeve 102 and the cathode holding member 105.

The cathode sleeve 102 has been baked in humid hydrogen. Black chromic oxide has been formed on the inner and outer surfaces of the cathode sleeve 102.

The cap member 103 is made of Ni at a purity degree of 99.9%. Also, a $BaCO_3$ layer, which is approximately 0.065 mm thick, has been formed as the electron emission material layer 104, on an outer surface the cap member 103.

The heater 101 is a 0.65 watt heater.

2. Specifications of Cathode Body as Comparative Example (1)

Specifications of a cathode body as a comparative example (1), which was produced in the same way as the cathode body 10 in Embodiment 1 except that it did not undergo the baking/blacking process, are as follows.

The cathode sleeve structure is the same as the cathode body 10 in Embodiment 1 in that it is made of Ni at a purity degree of 99.9%, but is different in that the cylindrical heater case member 14*a* has a diameter of 1.5 mm, and is 2.5 mm high and 0.1 mm thick.

The cathode sleeve supporting member is the same as the cathode body 10 in Embodiment 1 in that it is 0.3 mm wide, but is different in that it is 2.0 mm long and 0.1 mm thick.

The cap member 15 is made of Ni at a purity degree of 99.9%. Also, a layer, which is approximately 0.065 mm thick and whose principal element is BaO (barium oxide), has been formed as the electron emission material layer 104, on an outer surface the cap member 15.

The heater is a 0.65 watt heater.

3. Specifications of Cathode Body as Comparative Example (2)

Specifications of a cathode body as a comparative example (2) differ from those of the cathode body 10 in Embodiment 1 only in that, as shown in FIG. 12, the cap member 15 and the heater case member interim bodies 14*e* are formed as one piece.

4. Specifications of Cathode Body as Comparative Example (3)

Specifications of a cathode body as a comparative example (3) are the same as those of the cathode body as the comparative example (1) in terms of the material and quality, except that the inner surface of the cathode sleeve structure has been blacked by a combination of a high-melting-point metal and an inorganic binder, where the high-melting-point metal is composed of tungsten powder having average particle diameter of 1 $\mu$m and sintered alumina having average particle diameter of 5–10 $\mu$m.

5. Specifications of Cathode Body as Comparative Example (4)

Specifications of a cathode body as a comparative example (4) are the same as those of the cathode body as the comparative example (1) in terms of the material and quality, except that 0.1% of Mg (magnesium) has been added to the material (Ni) of the cathode sleeve structure 14.

6. Specifications of Cathode Body as Comparative Example (5)

Specifications of a cathode body as a comparative example (4) are the same as those of the cathode body as the comparative example (1) in terms of the material and quality, except that the cathode sleeve structure 14 has been blacked by allowing the cathode sleeve structure made of 20% of Cr and 80% of Ni to undergo a hydrogen process, then an oxidation process at approximately 700° C., then a baking process at approximately 1000° C. in humid hydrogen, so that a layer of $Cr_2O_3$ is formed on a surface of the cathode sleeve structure.

Now, the results of the test conducted on the above-described six test samples will be described.

Note that in FIGS. 16-19, the conventional cathode body is expressed by "(conventional)", and cathode bodies as the comparative examples (1)–(5) are expressed by "(1)–(5)", respectively.

Test Results

Figure 16:
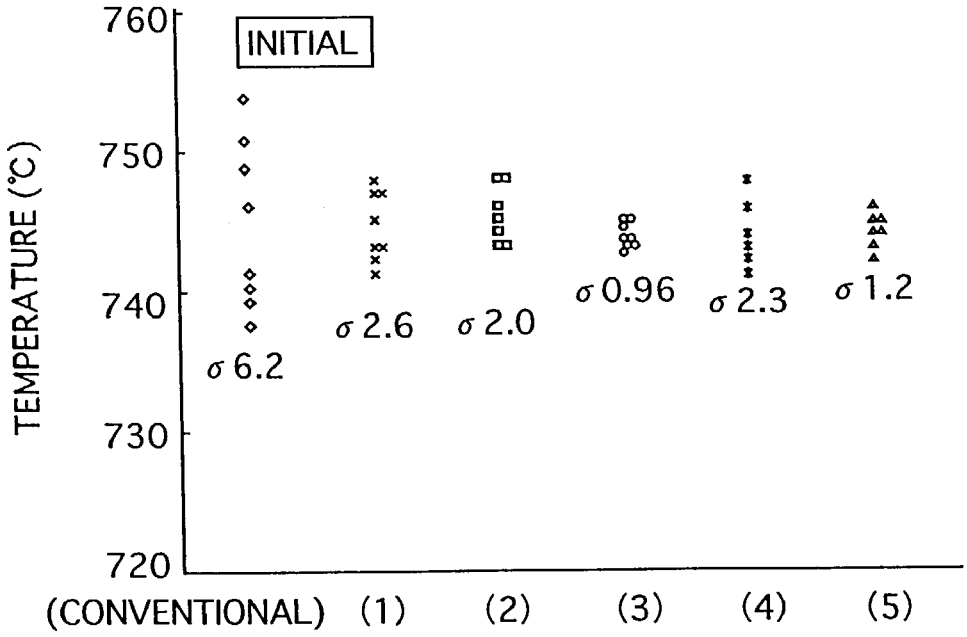
FIG. 16 shows the temperatures of the cathode bodies at an initial stage immediately after they were started to be operated.

FIG. 16 shows the temperatures of the cathode bodies at an initial stage immediately after they were started to be operated.

The inventors measured the temperatures of the cathode bodies as the test samples at the initial stage, and obtained the variations, namely the standard deviation.

The reason why the inventors obtained the temperature variations is as follows.

A color cathode ray tube contains three cathode bodies. If the operation temperatures of the cathode bodies vary greatly, the speeds at which the electron emission characteristics of the electron emission material layers degrade differ from each other, then the three electron beam currents of the cathode ray tube vary. This causes the white balance to come undone, and causes color tone deficiencies.

It should be noted here that the electron beam current of each cathode body is obtained as a ratio of an electric current value after a lapse of 2,000 hours to the initial one.

It has been found that the variation in the temperature of cathode body is caused by the difference in the amount of heat conducted from the heater 11 to the electron emission material layer 16.

That is to say, a challenge to be addressed in the product or production is to suppress the difference in the amount of conducted heat.

Here, as shown in FIG. 16, the standard deviation of the conventional cathode body temperature at the initial stage is "6.2", and the standard deviations of the comparative examples (1) to (5) are "2.6", "2.0", "0.96", "2.3", and "1.2", respectively.

The obtained values indicate that the comparative examples (1) to (5) have smaller variation in the temperature immediately after the operation start, than the conventional cathode body.

The tendency is prominent in the comparative examples (3) and (5).

Figure 17:
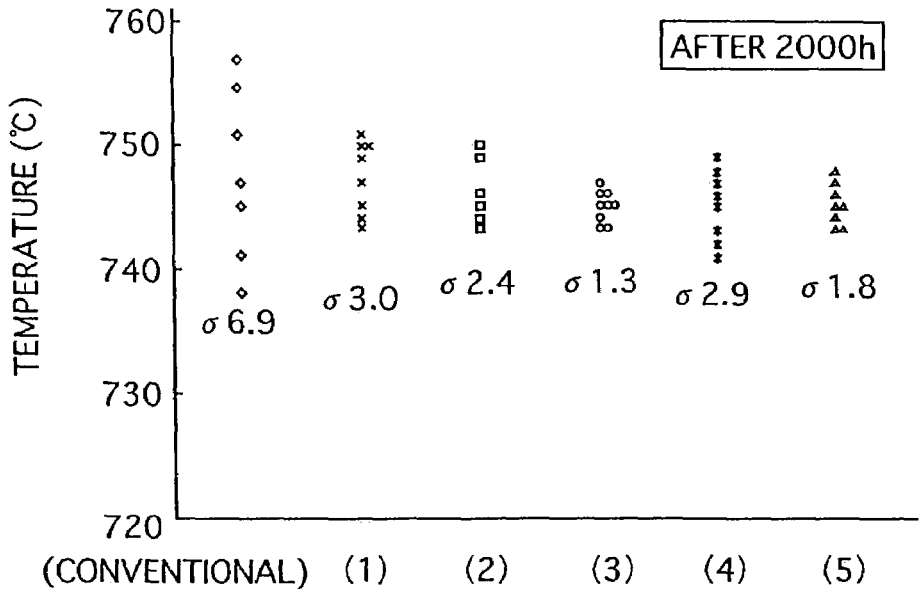
FIG. 17 shows the temperatures of the cathode bodies after a lapse of 2,000 hours since the operation start.

FIG. 17 shows the temperatures of the cathode bodies after a lapse of 2,000 hours since the operation start.

As shown in FIG. 17, the standard deviation of the conventional cathode body temperature after a lapse of 2,000 hours is "6.9", and the standard deviations of the comparative examples (1) to (5) are "3.0", "2.4", "1.3", "2.9", and "1.8", respectively.

The obtained values indicate that the comparative examples (1) to (5) have smaller variation in the temperature after a lapse of 2,000 hours, than the conventional cathode body.

The tendency is prominent in the comparative examples (3) and (5), as is the case with the initial stage.

Figure 18:
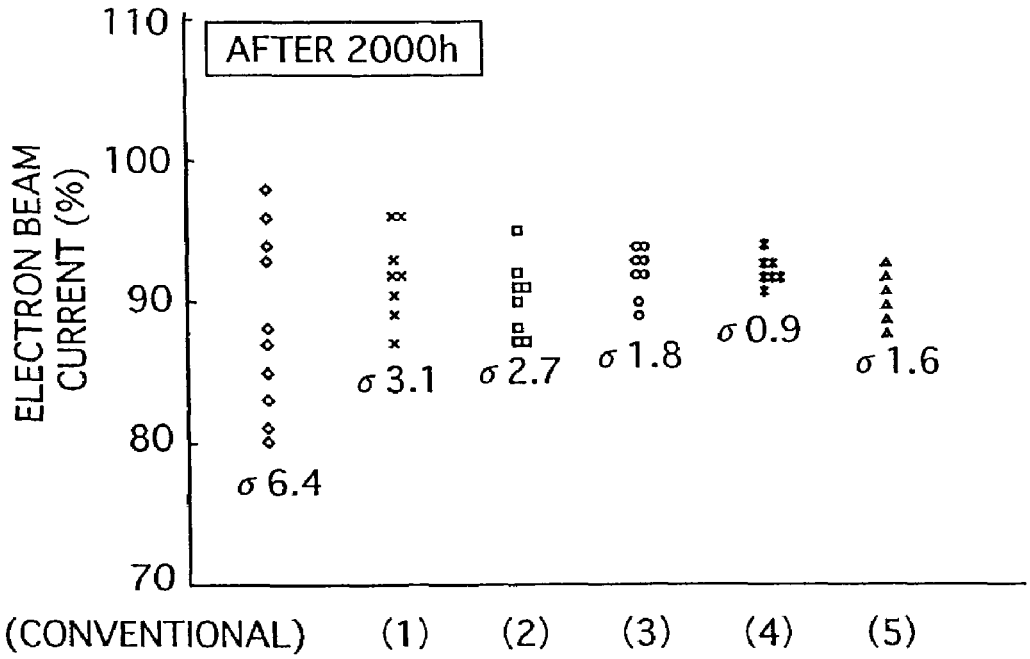
FIG. 18 shows the electron beam currents of the cathode bodies.

FIG. 18 shows the electron beam currents of the cathode bodies after a lapse of 2,000 hours since the operation start.

As shown in FIG. 18, the standard deviation of the electron beam current of the conventional cathode body after a lapse of 2,000 hours is "6.4", and the standard deviations of the comparative examples (1) to (5) are "3.1", "2.7", "1.8", "0.9", and "1.6", respectively.

The results indicate that the comparative examples (1) to (5) have smaller variation in the electron beam current, than the conventional cathode body.

The tendency is prominent in the comparative example (4).

Figure 19:
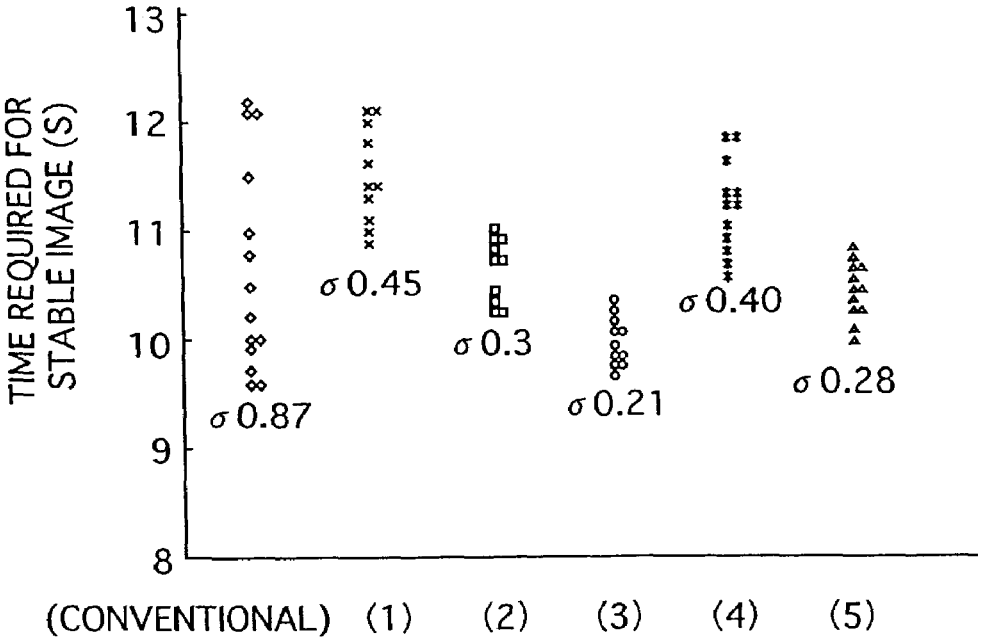
FIG. 19 shows a time required to display a stable image.

FIG. 19 shows, for each test sample, a time required to display a stable image on the cathode ray tube, that is, a time required to output 80% of a cathode current.

As shown in FIG. 19, the standard deviation of the time required to display a stable image of the conventional cathode body is "0.87", and the standard deviations of the comparative examples (1) to (5) are "0.45", "0.3", "0.21", "0.40", and "0.28", respectively.

The results indicate that the comparative examples (1) to (5) have smaller variation in the time required to display a stable image, than the conventional cathode body.

The tendency is prominent in the comparative examples (2), (3), and (5), where the time required to display a stable image is relatively short.

As understood from the above-described test results, the comparative examples (1) to (5) have enough qualities as the products since they have smaller variations in the temperature and electron beam current, compared with the conventional cathode body.

It is considered that one of the reasons why the cathode bodies (1) to (5) have smaller variations in the temperature and electron beam current than the conventional one is that the cylindrical heater case member 14*a* and the cathode sleeve supporting member 14*b* are formed as one piece, not bonded together by welding, and that therefore the obtained products are stable in shape and the variation in the heat loss is suppressed in each cathode body.

Also, in the cathode bodies as the comparative examples (1) to (4), the cathode sleeve structure is made of a material whose principal element is Ni. However, Fe (iron), Co (cobalt), or Cr may be used as the principal element of the cathode sleeve structure. Also, the cathode sleeve structure may be made of a material that contains Ni as its principal element, and Fe or Co as well.

Here, an optimal combination of materials may be selected from the above-described options, considering the heat conductivity, coefficient of thermal expansion, rigidity, and cost of the cathode sleeve structure 14.

To increase the heat resistance, it is desirable to form the cathode sleeve structure 14 using, as its principal element, any of Ta (tantalum), Mo (molybdenum), and Nb (niobium) that have high melting points of no lower than 2,000° C.

In the cathode body as the comparative example (4), Mg is used as an additive. However, Cr, Si (silicon), W (tungsten), or Al (aluminum) may be used as an additive, instead of Mg. Also, any combination of the above-mentioned metals may be used as an additive in the cathode body.

Also, the cathode sleeve structure 14 may be formed by containing, as its principal element, any of Fe, Co, Ta, Mo, Nb, and Cr, and any combination of metals selected from Mg, Si, Cr, W, and Al as an additive. Needless to say, Cr is not used both as its principal element and an additive.

The cathode body in Embodiment 1 has been described in terms of an oxide cathode that is used in a general-purpose cathode ray tube. However, the cathode body is applicable to an impregnation-type cathode that is used in a high-brightness, high-definition cathode ray tube.

The cathode body to be applied to a high-brightness, high-definition cathode ray tube may be formed by covering a porous tungsten pellet with a cap, and welding the tungsten pellet to the cathode sleeve structure 14, not by forming the electron emission material layer 16 on the cap member 15 by spraying the electron emission material.

Alternatively, the cathode body may be formed by welding the tungsten pellet onto the top-surface member 14*j* shown in FIG. 12.

Embodiment 2

The following describes a cathode body 30 in Embodiment 2.

Construction

As is the case with the cathode body 10 in Embodiment 1, the cathode body 30 is used in a cathode ray tube and includes a cathode for generating electrons and a member for supporting the cathode.

The cathode body 30 has the same construction as the cathode body 10 except that the heater case member 14*a* and the heater case member interim bodies 14*e* are partially modified in shape.

The following will describe the differences between the cathode body 30 and the cathode body 10.

Note that for the sake of conveniences, some components of the cathode body 30 in Embodiment 2 are assigned different reference numbers from corresponding components in Embodiment 1. The cathode body member 32, interim product 32*a*, cathode holding member 33, cathode sleeve structure 34, heater case member 34*a*, cathode sleeve supporting members 34*b*, outer linkage member 34*c*, cathode sleeve interim bodies 34*d*, heater case member interim bodies 34*e*, supporting member interim bodies 34*f*, outer linkage member interim bodies 34*g* in Embodiment 2 correspond to the components 12, 12*a*, 13, 14, 14*a*, 14*b*, 14*c*, 14*d*, 14*e*, 14*f*, and 14*g* in Embodiment 1, respectively.

Figure 20:
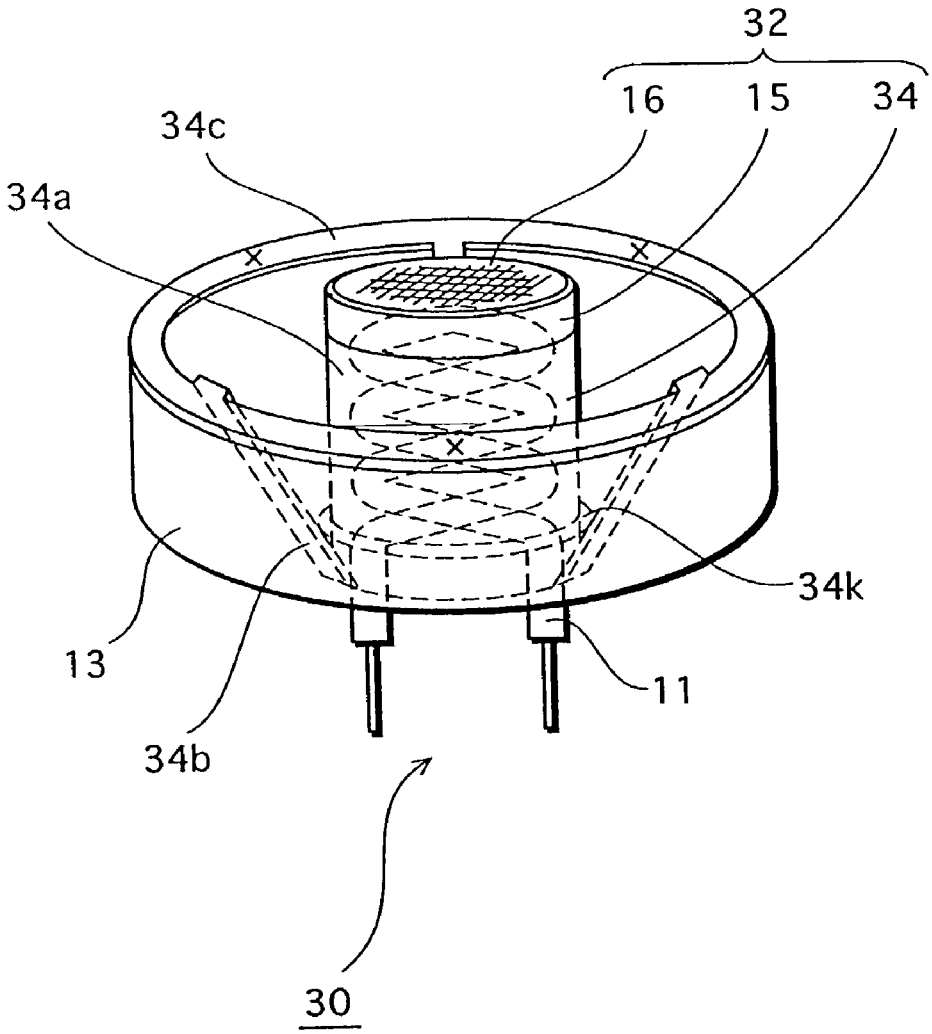
FIG. 20 shows the construction of the cathode body in Embodiment 2.

As shown in FIG. 20, the cathode body 30 differs from the cathode body 10 in that it has a flange 34*k* at a lower part of the cylindrical heater case member 14*a*.

Production Method

Now, a production method of the cathode body 30 will be described.

The flange 34*k* is formed in the first process in Embodiment 1, the cathode sleeve substrate forming process. The other processes are the same as Embodiment 1, except that in the bending process, a bending jig in a different shape from that in Embodiment 1 is used.

The following is a description of the cathode sleeve substrate forming process and the bending process which are different from Embodiment 1.

Cathode Sleeve Substrate Forming Process

Figure 21A:
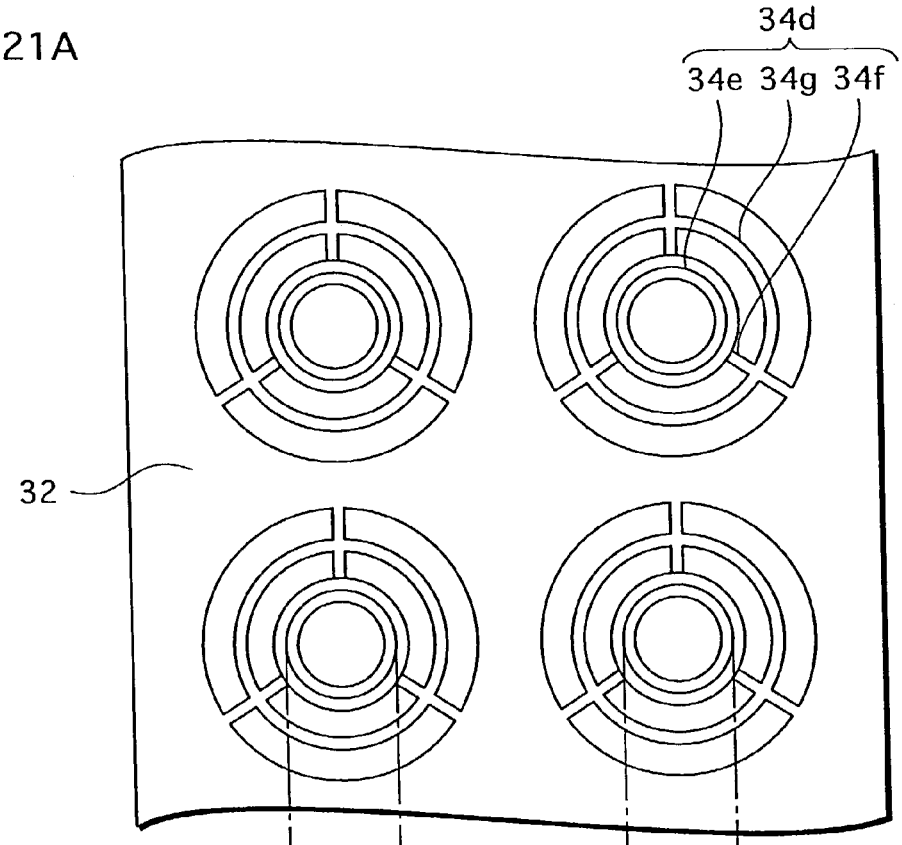
FIG. 21A is a top plan view of the cathode sleeve interim body of the cathode body in Embodiment 2.
Figure 21B:
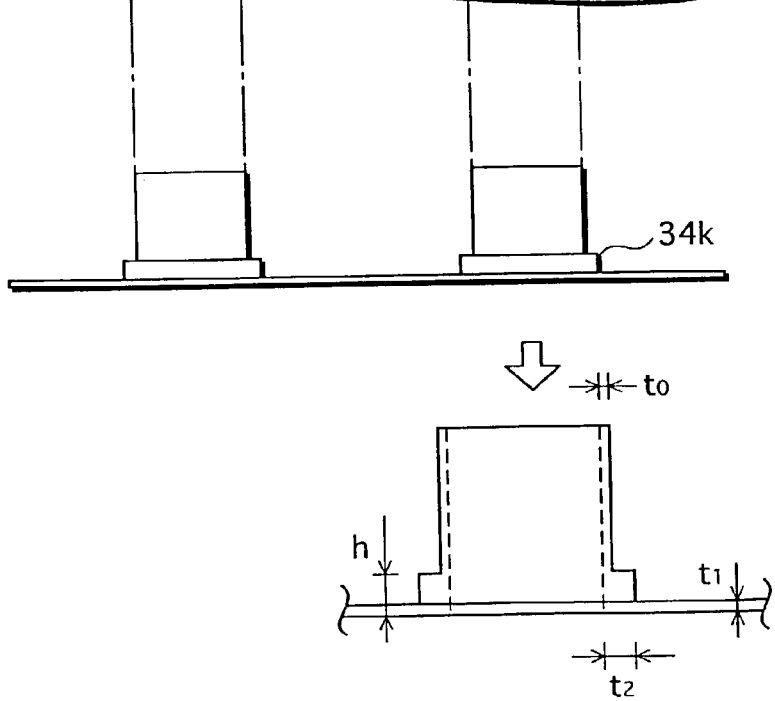
FIG. 21B is a side view of the cathode sleeve interim body of the cathode body in Embodiment 2.

The heater case member interim body 14*e* of the cathode body 10 in Embodiment 1 has a constant thickness t0 0.05 mm, except for portions from which the supporting member interim bodies 14*f* extend. In contrast, the heater case member interim body 34*e* of the cathode body 30*f* in Embodiment 2 has the flange 34k that is 0.03 mm (t2−t0) thick and 0.1 mm high, as shown in FIG. 21. The supporting member interim bodies 34*f* extend from flange 34k. The heater case member interim body 34*e* is formed to have a thickness t2 of 0.08 mm at the lower part to extend outward. This extending portion is the flange 34k.

Bending Process

Figure 22A:
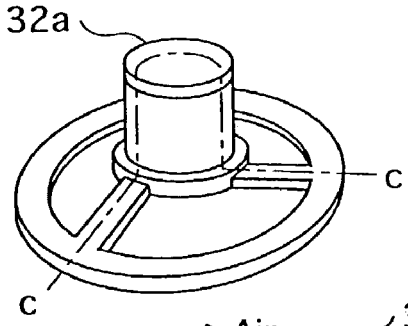
FIG. 22A shows an interim product immediately before it is subjected to the bending process in Embodiment 2.
Figure 22B:
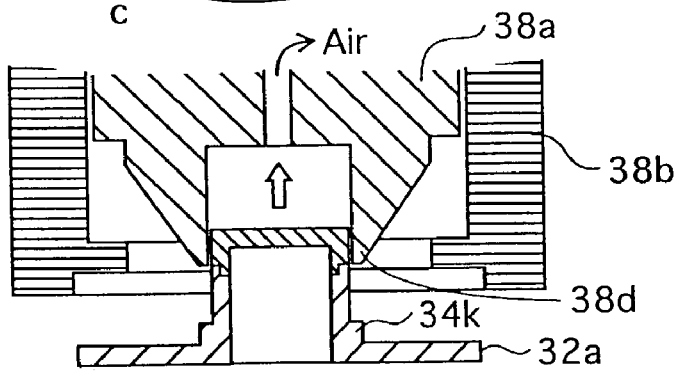
FIG. 22B shows how the interim product is set in a bending jig in the bending process in Embodiment 2.

FIG. 22A shows an interim body 32*a*. FIG. 22B shows a cross-sectional view of the interim body 32*a*. As shown in FIG. 22B, the interim body 32*a* is thicker at a portion where the flange 34*k* is formed, than any other portions.

As shown in FIG. 22B, the interim body 32*a* is set in a depression of a bending jig 38*a* in which a negative pressure is applied.

Figure 22C:
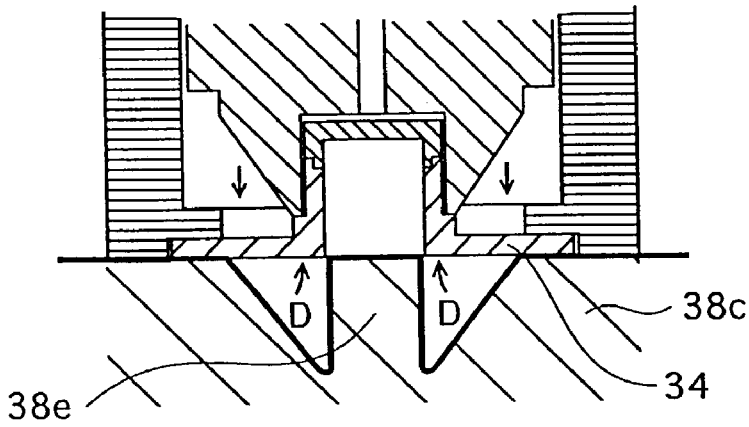
FIG. 22C shows how the bending jig moves in the bending process in Embodiment 2.
Figure 22D:
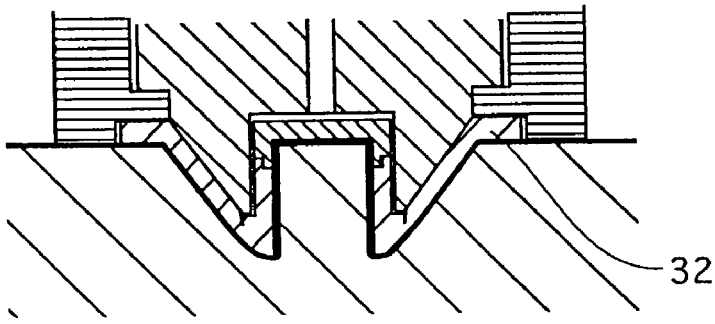
FIG. 22D shows how the bending jig moves and the interim product is shaped in the bending process in Embodiment 2.

It should be noted here that the cross-sectional view of the interim product 32*a* shown in FIGS. 22B through 22D is taken substantially along line C—C of FIG. 22A.

As shown in FIG. 22C, the bending jig 38*b* is lowered until it contacts the bending jig 38*c*, by keeping the relative positions between the bending jigs 38*a* and 38*b* unchanged.

As shown in FIG. 22D, the bending jig 38*a* is then further lowered while a tip 38*d* of the bending jig 38*a* is contacting the top surface of the flange 34*k*. This allows a protrusion 38*e* of the bending jig 38*c* to be inserted into the heater case member 34*a* of the interim product 32*a*, and the supporting member interim bodies 34*f* are bent at their roots toward the cap member 15 at acute angles, forming the cathode body member 32.

In the bending process in Embodiment 1, the supporting member interim bodies 14*f* being 0.05 mm thick are bent while they are directly sandwiched by the bending jigs 28*a* and 28*b*. In such an operation, a shearing force may be applied to bucking B (see FIG. 9C) of the supporting member interim bodies 14*f* depending on the variation of the amount of stroke in the bending jigs, and a crack may be generated.

In the bending process in Embodiment 2, when the bending jig 38*a* is lowered to bend the supporting member interim bodies 34*f*, the tip 38*d* of the bending jig 38*a* is contacting the top surface of the thick flange 34*k*, not the thin supporting member interim bodies 34*f*. As a result, bucking D is less apt to have a crack.

That is to say, the shape improved by the flange 34*k* and the improved bending process further increase the yield of the cathode body 30.

Restriction in Height of Flange 34*k*

Though the flange 34*k* increases the yield of the cathode body 30 as described above, it may increase the amount of heat loss, namely amount of heat conducted from the cathode sleeve structure 34 to the cathode holding member 33.

More specifically, the higher the height "h" of the flange 34*k* is, the larger the amount of heat loss, namely amount of heat conducted from the cathode sleeve structure 34 to the cathode holding member 33 is.

Figure 23:
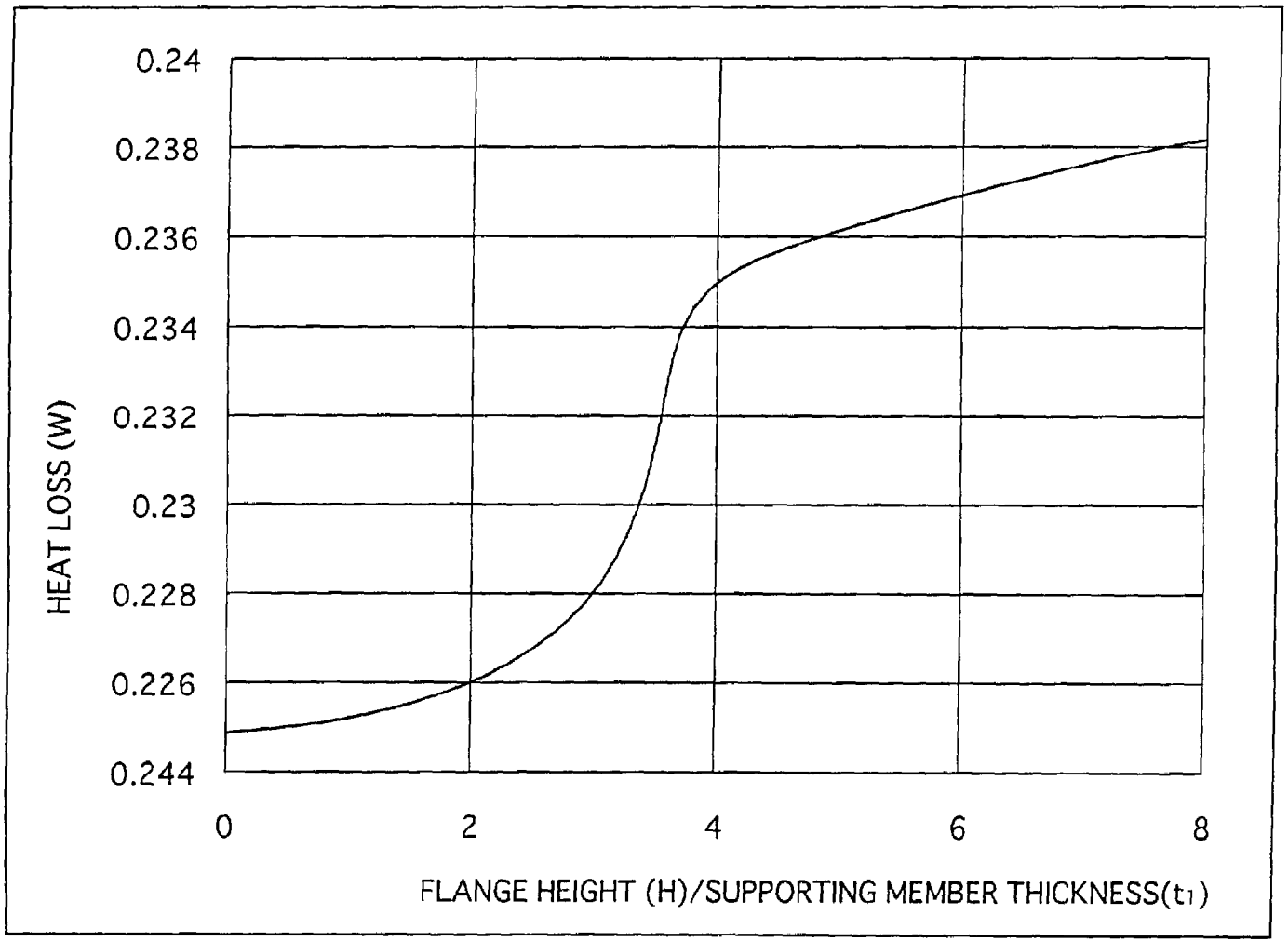
FIG. 23 shows a plot of the heat loss vs. a value obtained by dividing the height of the flange by the thickness of the supporting member.

The inventors, after an elaborate investigation, have found that when the heater case member 34*a* is 0.05 mm thick and the cathode sleeve supporting member 34*b* is 0.05 mm thick and 0.25 mm wide, a certain correspondence between (a) the heat loss and (b) a value (hereinafter referred to as shape ratio value (C)) obtained by dividing the height h of the flange 34*k* by the thickness t1 of the cathode sleeve supporting member 34*b* is observed. FIG. 23 shows a plot of the heat loss vs. the shape ratio value (C).

As shown in FIG. 23, the heat loss prominently changes and increases by approximately 4% when the shape ratio value (C) increases from 2 to 4.

The inventors determined an upper limit of the shape ratio value (C) to be 3.5, considering the above-described deterioration in the heat loss.

The inventors also determined a lower limit of the shape ratio value (C) to be 1. This is because when the height h of the flange 34*k* is smaller than the thickness t1 of the cathode sleeve supporting member 34*b*, that is, when the shape ratio value (C) is smaller than 1, the tip 38*d* of the bending jig 38*a* contacts the cathode sleeve supporting members 34*b* faster in the bending process, and the cathode sleeve supporting members 34*b* is apt to have a crack due to a shearing force.

The inventors have also found that to improve the yield in the bending process while restricting the heat loss, it is desirable to set the shape ratio value (C) to 2. This is because the inventors noted that when the shape ratio value (C) increases gradually and reaches 2, the heat loss starts to change (increase) greatly.

For the above reason, the height h of the flange 34*k* is set to 0.1 mm in correspondence with the desirable value "2" of the shape ratio value (C).

With the above-described construction and method, when the cathode sleeve supporting members 34*b* are bent in the bending process for the cathode body 30, a direct application of the shearing force to the cathode sleeve supporting members 34*b* is prevented. This prevents the cathode sleeve supporting members 34*b* from having a crack, and improves the yield of the cathode body.

In Embodiment 2, the heater case member interim body 34*e* is formed to have a thickness t2 of 0.08 mm at the lower part where the flange 34*k* extends. However, not limited to this, the thickness may be varied in so far as the flange 34*k* can hold the tip 38*d* of the bending jig 38*a* at its top when the bending jig 28*a* is lowered, and the heat loss does not exceed a permissible limit.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cathode body for housing a heater, comprising:

a case member that is cylindrical and an end thereof is open;

a plurality of supporting members that extend radially from vicinities of the end of the case member;

a holding member that surrounds the case member; and a plurality of extending members that each of which extends from a different one of the plurality of supporting members to be a circular arc along a circular end of the holding member and to be close to adjacent extending members, wherein the case member, the plurality of supporting members, and the plurality of extending members are formed as one piece, and the holding member is bonded to either (i) ends of the plurality of supporting members or (ii) the plurality of extending members so that the case member is fixed substantially at a center of the holding member.

2. The cathode body of claim 1, wherein the plurality of extending members respectively extend from free ends of the plurality of supporting members, while the other ends are connected to the case member.

3. The cathode body of claim 2, wherein the plurality of extending members are substantially on a same circle.

4. The cathode body of claim 3, wherein the portions of each pair of adjacent extending members being close to each other are ends thereof.

5. The cathode body of claim 4, wherein a distance between each pair of adjacent extending members is no greater than 0.5 mm.

6. A cathode ray tube, comprising:

an electron gun including the cathode body defined in claim 1.

7. A cathode sleeve structure for housing a heater, comprising:

a case member that is cylindrical and has a first end and a second end, the first end being open, and the case member being thicker at the first end than any other portions thereof so that a step is formed on an outer surface at the first end; and a plurality of supporting members that extend radially from the step at the first end of the case member, and are bent at vicinities of boundaries between the step and the supporting members toward the second end.

8. The cathode sleeve structure of claim 7, wherein each of the plurality of supporting members is a plate being t mm thick, and a length of the step in a longitudinal direction of the case member is no smaller than t mm and no larger than 3.5 t mm.

9. A cathode body, comprising: the cathode sleeve structure defined in claim 7; and a holding member that is bonded to ends of the plurality of supporting members so that the cathode sleeve structure is fixed substantially at a center of the holding member.

10. A cathode ray tube, comprising:

an electron gun including the cathode body defined in claim 9.

11. A cathode body for housing a heater, comprising:

a case member that is cylindrical and an end thereof is open; and a plurality of supporting members that extend radially from vicinities of the end of the case member;

a holding member that surrounds the case member; and a plurality of extending members that each of which extends from a different one of the plurality of supporting members to be substantially on a same circle along a circular end of the holding member so that a distance between each pair of adjacent extending members is no longer than 0.5 mm, wherein the case member, the plurality of supporting members, and the plurality of extending members are formed as one piece, and the holding member is bonded to either (i) ends of the plurality of supporting members or (ii) the plurality of extending members so that the case member is fixed substantially at a center of the holding member.

* * * * *